US011634882B2

(12) United States Patent
Yamamoto

(10) Patent No.: US 11,634,882 B2
(45) Date of Patent: Apr. 25, 2023

(54) EXCAVATOR

(71) Applicant: SUMITOMO CONSTRUCTION MACHINERY CO., LTD., Tokyo (JP)

(72) Inventor: Takashi Yamamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 364 days.

(21) Appl. No.: 16/859,108

(22) Filed: Apr. 27, 2020

(65) Prior Publication Data

US 2020/0256034 A1 Aug. 13, 2020

Related U.S. Application Data

(63) Continuation of application No. PCT/JP2018/039098, filed on Oct. 19, 2018.

(30) Foreign Application Priority Data

Nov. 10, 2017 (JP) ..... JP2017-217304

(51) Int. Cl.

| | |
|---|---|
| ***E02F 3/43*** | (2006.01) |
| ***E02F 3/32*** | (2006.01) |
| ***E02F 9/20*** | (2006.01) |
| ***E02F 9/22*** | (2006.01) |
| ***E02F 9/26*** | (2006.01) |

(52) U.S. Cl.

CPC ..... *E02F 3/435* (2013.01); *E02F 3/32* (2013.01); *E02F 3/439* (2013.01); *E02F 9/2033* (2013.01); *E02F 9/2041* (2013.01); *E02F 9/2203* (2013.01); *E02F 9/2228* (2013.01); *E02F 9/26* (2013.01)

(58) Field of Classification Search

CPC ..... E02F 3/435; E02F 3/439; E02F 9/2203; E02F 9/2033

See application file for complete search history.

(56) References Cited

U.S. PATENT DOCUMENTS 5,975,214 A 11/1999 Okamura et al.
2005/0177292 A1* 8/2005 Okamura ..... E02F 9/2207 701/50

(Continued)

FOREIGN PATENT DOCUMENTS

DE 112016000156 8/2017
EP 3159455 4/2017

(Continued)

OTHER PUBLICATIONS

International Search Report for PCT/JP2018/039098 dated Dec. 18, 2018.

*Primary Examiner* — Abiy Teka
(74) *Attorney, Agent, or Firm* — IPUSA, PLLC

(57) ABSTRACT

An excavator may perform a finishing operation to prepare a slope while maintaining workability. The excavator includes an undercarriage, a slewing upper structure rotatably mounted on the undercarriage, a boom pivotally mounted on the upper structure, an arm rotatably mounted on a tip end of the boom, a bucket mounted on a tip end of the arm, and a controller. The controller restricts a lowering operation of the boom, so that at least one of a pressing force of the bucket against the ground and a speed of lowering the bucket toward the ground does not become relatively large.

16 Claims, 18 Drawing Sheets

(56) References Cited

U.S. PATENT DOCUMENTS

| | | | | |
|---|---|---|---|---|
| 2016/0237655 | A1 | 8/2016 | Baba et al. | |
| 2018/0230672 | A1 | 8/2018 | Matsuyama et al. | |
| 2019/0226181 | A1* | 7/2019 | Imura ..... | E02F 9/2221 |

FOREIGN PATENT DOCUMENTS

| | | |
|---|---|---|
| JP | H01-014430 | 1/1989 |
| JP | H02-204531 | 8/1990 |
| JP | H07-305375 | 11/1995 |
| JP | H09-189052 | 7/1997 |
| JP | H10-037230 | 2/1998 |
| JP | H10-219727 | 8/1998 |
| JP | 2009-180065 | 8/2009 |
| JP | 2015-140800 | 8/2015 |
| JP | 2015-229836 | 12/2015 |
| WO | 2015114909 | 8/2015 |
| WO | 2017/047695 | 3/2017 |

* cited by examiner

EXCAVATOR

CROSS REFERENCE TO RELATED APPLICATIONS

This application is a continuation application of International Application No. PCT/JP2018/039098 filed on Oct. 19, 2018 and designated the U.S., which is based upon and claims priority to Japanese Patent Application No. 2017-217304, filed on Nov. 10, 2017, the entire contents of which are incorporated herein by reference.

BACKGROUND OF THE INVENTION

1. Field of the Invention

The present invention relates to an excavator.

2. Description of the Related Art

For example, a construction machinery, such as an excavator or the like, may be used to prepare a slope (perform slope construction) at a construction site.

When performing the slope construction, there are cases where the slope is generally formed by excavating the slope by a bucket, shaping the slope, and thereafter performing a finishing operation to prepare the slope (hereinafter referred to a "slope finishing operation" for the sake of convenience) while pressing a rear face of the bucket against the slope.

However, when the slope finishing operation is performed by the bucket while performing a boom lowering operation or the like by the excavator, the slope may collapse if a momentum of the boom lowering operation or the like is too large, for example. Similarly, when the slope finishing operation is performed by the bucket, the excavator itself may be lifted due to a reaction force from the slope if the momentum of the boom lowering operation or the like is too large, for example.

On the other hand, when an operator performs the boom operation while making suitable adjustments so as to prevent the slope of a target object from collapsing, prevent the excavator from being lifted, or the like, the workability deteriorates because it is necessary to find a suitable operating state according to a state of an operation site, such as the hardness of the ground or the like.

SUMMARY OF THE INVENTION

Accordingly, one object of the embodiments is to provide an excavator that can appropriately perform the slope finishing operation to prepare the slope, while maintaining the workability.

According to one aspect of the embodiments, an excavator includes a carriage, a structure rotatably mounted on the carriage, a boom pivotally mounted on the structure, an arm rotatably mounted on a tip end of the boom, a bucket mounted on a tip end of the arm, and a controller configured to restrict a lowering operation of the boom, so that at least one of a pressing force of the bucket against the ground and a speed of lowering the bucket toward the ground does not become relatively large.

Other objects and further features of the present invention will be apparent from the following detailed description when read in conjunction with the accompanying drawings.

DESCRIPTION OF THE PREFERRED EMBODIMENTS

Figure 1:
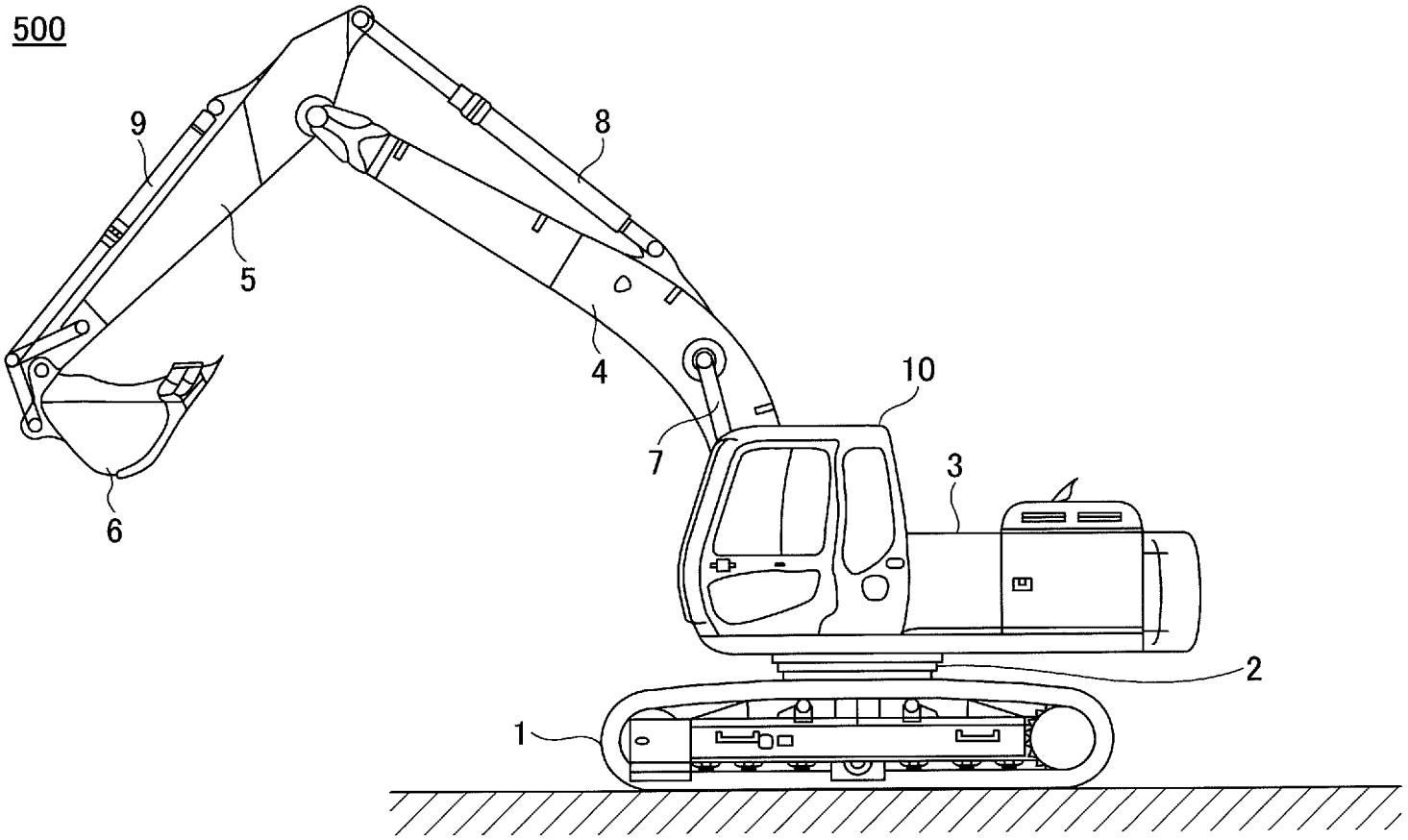
FIG. 1 is a side view of an excavator.

Embodiments of the present invention will be described in the following, by referring to the drawings.

[General Outline of Excavator]

First, a general outline of an excavator 500 according to this embodiment will be described, by referring to FIG. 1.

FIG. 1 is a side view of the excavator 500 according to this embodiment.

The excavator 500 according to this embodiment includes an undercarriage 1, a slewing upper structure 3 rotatably mounted on the undercarriage 1 via a slewing mechanism 2, attachments (working devices) including a boom 4, an arm 5, and a bucket 6, and a cabin 10 to be boarded by an operator. In the following, the front of the excavator 500 corresponds to an extending direction of the attachment (hereinafter simply referred to as an "attachment extending direction") with respect to the slewing upper structure 3, in a plan view from immediately above the excavator 500 along a turning shaft of the slewing upper structure 3 (hereinafter simply referred to as a "plan view"). In addition, the right and the left of the excavator 500 respectively correspond to the right and the left of the operator inside the cabin 10, in the plan view of the excavator 500.

The undercarriage 1 (an example of a lower structure) includes a pair of crawlers formed by right and left crawlers, and the respective crawlers are hydraulically driven by crawler hydraulic motors 1A and 1B (refer to FIG. 2A and FIG. 2B), to cause the excavator 500 to crawl.

Figure 2A:
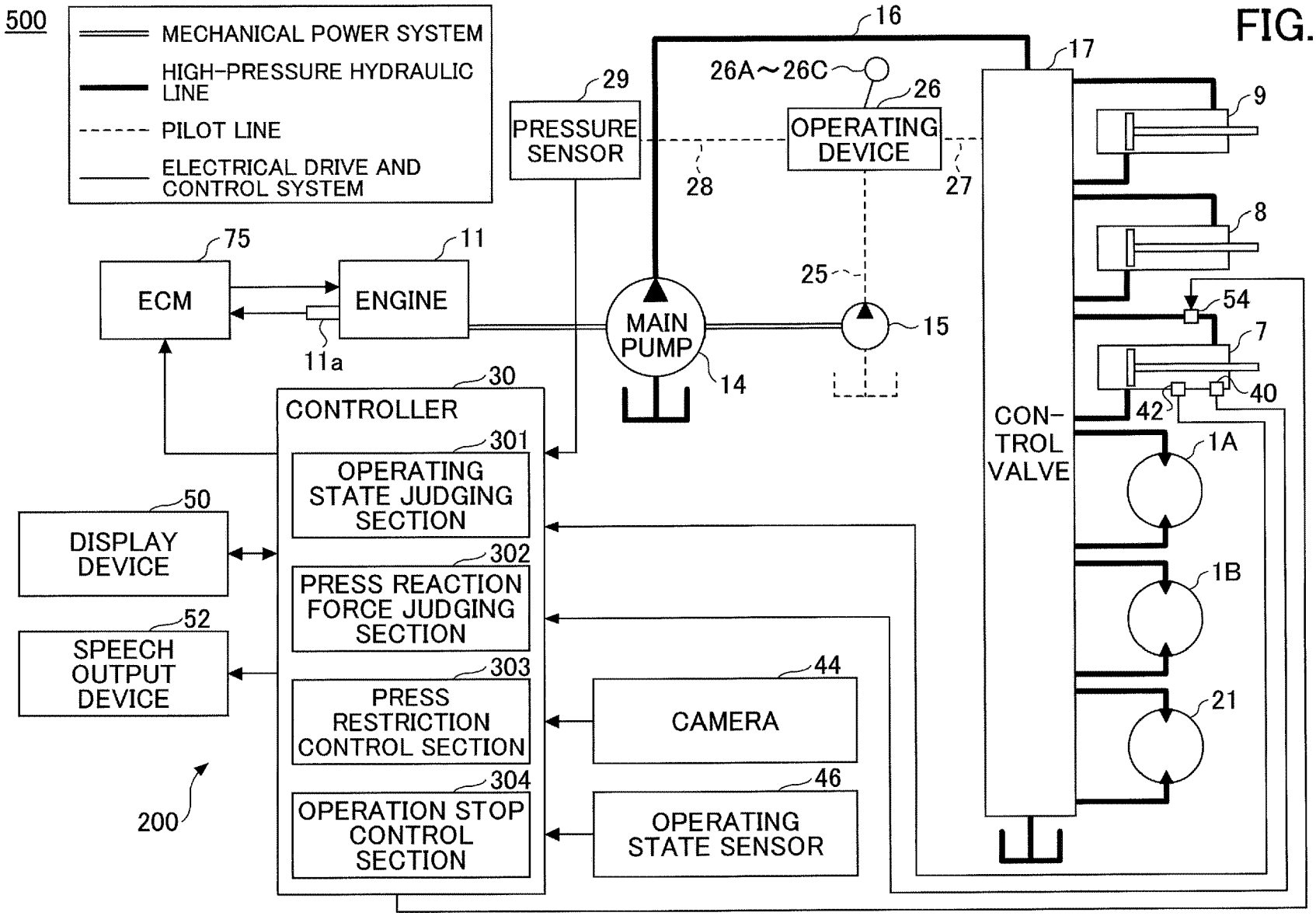
FIG. 2A is a block diagram illustrating an example of a structure of the excavator.
Figure 2B:
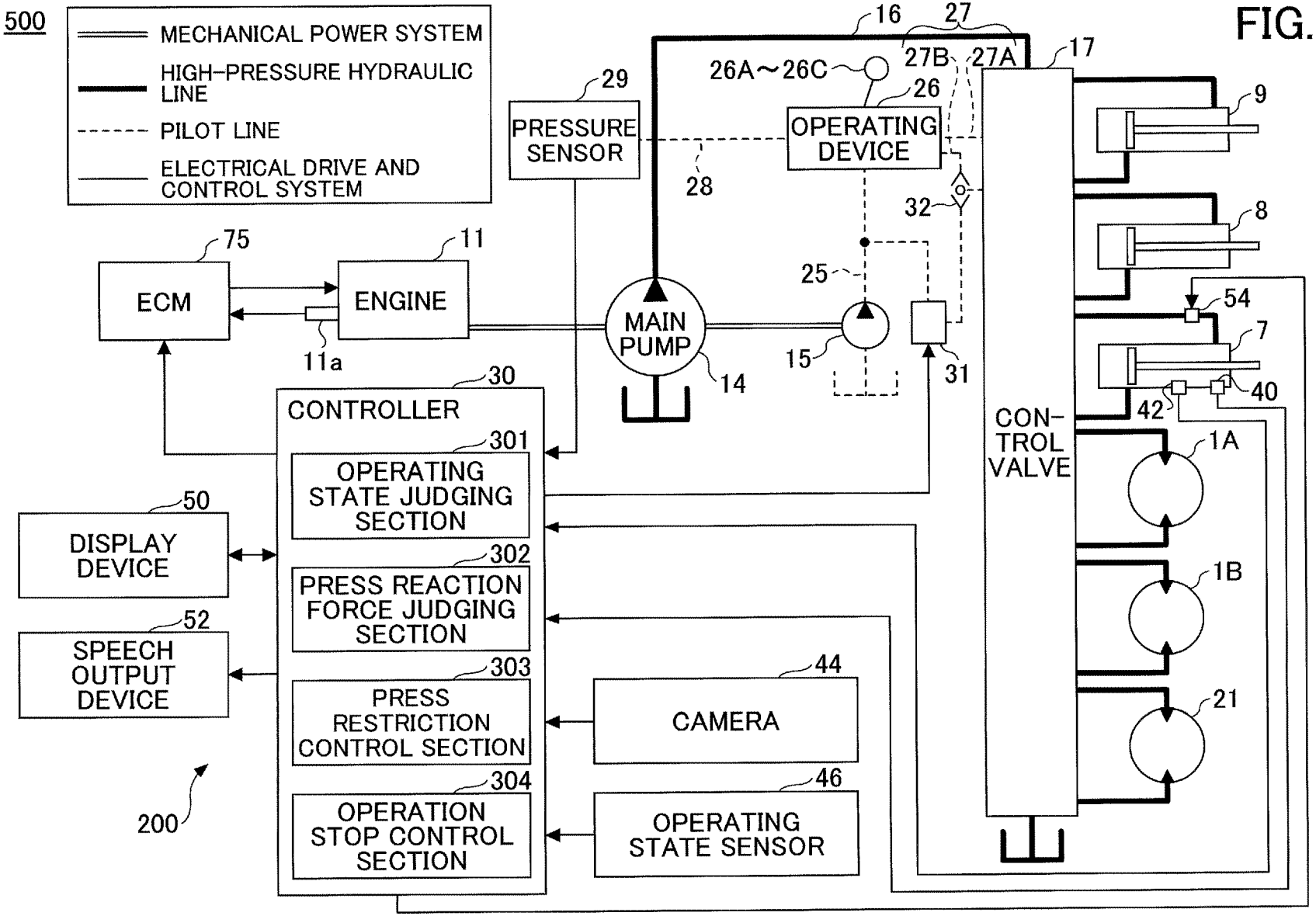
FIG. 2B is a block diagram illustrating another example of the structure of the excavator.

The slewing upper structure 3 (an example of an upper structure) turns with respect to the undercarriage 1, by being driven by a turning hydraulic motor 21 (refer to FIG. 2A and FIG. 2B).

The boom 4 is pivotally mounted at the front center of the slewing upper structure 3 and is able to pitch, and the bucket 6 (an example of an end attachment) is pivotally mounted at a tip end of the arm 5 and is able to turn upward and downward. The boom 4, the arm 5, and the bucket 6 are respectively hydraulically driven by a boom cylinder 7, an arm cylinder 8, and a bucket cylinder 9 that are provided as hydraulic actuators.

The cabin 10 is a craneman's house that is boarded by the operator, and is mounted on the front left of the slewing upper structure 3.

[Basic Structure of Excavator]

Next, a basic structure of the excavator 500 will be described, by referring to FIG. 2A and FIG. 2B. FIG. 2A and FIG. 2B are block diagrams respectively illustrating an example and another example of the structure of the excavator 500 according to this embodiment.

In FIG. 2A and FIG. 2B, a mechanical power system is indicated by a double line, a high-pressure hydraulic line is indicated by a bold solid line, a pilot line is indicated by a dashed line, and an electrical drive and control system is indicated by a thin solid line, respectively.

A hydraulic driving system, that hydraulically drives hydraulic actuators of the excavator 500 according to this embodiment, includes an engine 11, a main pump 14, a control valve 17, or the like. In addition, as described above, the hydraulic driving system of the excavator 500 according to this embodiment includes the crawler hydraulic motors 1A and 1B, the turning hydraulic motor 21, the boom cylinder 7, the arm cylinder 8, the bucket cylinder 9, or the like that hydraulically drive the undercarriage 1, the slewing upper structure 3, the boom 4, the arm 5, and the bucket 6, respectively.

The engine 11 is a main power source of the hydraulic driving system, and is mounted at the rear of the slewing upper structure 3. More particularly, the engine 11 rotates at a constant target engine speed that is preset, under a control of an engine control module (ECM) 75 that will be described later, and drives the main pump 14 and a pilot pump 15. The engine 11 is a diesel engine that uses a light oil as the fuel.

The main pump 14 is mounted at the rear of the slewing upper structure 3, for example, similar to the engine 11, and supplies a hydraulic oil to the control valve 17 via the high-pressure hydraulic line 16. The main pump 14 is driven by the engine 11. The main pump 14 is a variable capacity hydraulic pump, for example, and is capable of controlling a discharge flow rate (a discharge pressure), by adjusting a stroke length of a piston by controlling an angle (an inclination angle) of a swash plate by a regulator (not illustrated) under a control of a controller 30 that will be described later.

The control valve 17 is mounted at the center of the slewing upper structure 3, for example, and is a hydraulic control device that controls the hydraulic driving system according to an operation performed by an operator with respect to an operating device 26. As described above, the control valve 17 connects to the main pump 14 via the high-pressure hydraulic line 16, and selectively supplies the hydraulic oil supplied from the main pump 14 to the hydraulic actuators including the crawler hydraulic motors 1A (for right) and 1B (for left), the turning hydraulic motor 21, the boom cylinder 7, the arm cylinder 8, and the bucket cylinder 9, according to the operating state of the operating device 26. More particularly, the control valve 17 is a valve unit including a plurality of hydraulic control valves (direction switching valves) that control the flow rate and the direction of the hydraulic oil supplied from the main pump 14 to each of the hydraulic actuators.

An operating system of the excavator 500 according to this embodiment includes the pilot pump 15, and the operating device 26. In addition, as illustrated in FIG. 2B, the operating system of the excavator 500 according to this embodiment may include a shuttle valve 32.

The pilot pump 15 is mounted at the rear of the slewing upper structure 3, and supplies a pilot oil to the operating device 26 via a pilot line 25. The pilot pump 15 is a fixed capacity hydraulic pump, for example, and is driven by the engine 11.

The operating device 26 includes levers 26A and 26B, and a pedal 26C. The operating device 26 is provided near an operator's seat in the cabin 10, and forms an operation input means, operated by the operator, for operating the various operation elements (the undercarriage 1, the slewing upper structure 3, the boom 4, the arm 5, the bucket 6, or the like). In other words, the operating device 26 forms the operation input means for operating the hydraulic actuators (the crawler hydraulic motors 1A and 1B, the turning hydraulic motor 21, the boom cylinder 7, the arm cylinder 8, the bucket cylinder 9, or the like) that drive the respective operation elements. The operating device 26 utilizes the hydraulic oil supplied from the pilot pump 15 via the pilot line 25, and outputs a pilot pressure in accordance with an operation content with respect to the operating device 26, to a pilot line 27 on a secondary side thereof.

As illustrated in FIG. 2A, the operating device 26 (that is, the levers 26A and 26B, and the pedal 26C) may be connected to the control valve 17 via the pilot line 27 on the secondary side thereof. Hence, pilot signals (pilot pressures) in accordance with the operating states of the undercarriage 1, the boom 4, the arm 5, the bucket 6, or the like in the operating device 26, are input to the control valve 17. For this reason, the control valve 17 can drive the respective hydraulic actuators according to the operating states in the operating device 26. In addition, the operating device 26 is connected to a pressure sensor 29 via a pilot line 28.

Further, as illustrated in FIG. 2B, the pilot line 27 may include a pilot line 27A that is directly connected to the control valve 17, and a pilot line 27B that is indirectly connected to the control valve 17 via the shuttle valve 32. Accordingly, a pilot pressure according to the operation content related to a portion (for example, the undercarriage 1, and slewing upper structure 3) of the various operation elements of the operating device 26, may be directly input to the control valve 17, and a pilot pressure according to the operation content related to a remaining portion (for example, the boom 4, the arm 5, and the bucket 6) of the various operation elements of the operating device 26, may be indirectly input to the control valve 17 via the shuttle valve 32. For this reason, the control valve 17 can drive the respective hydraulic actuators according to the operator's operation content with respect to the operating device 26.

In FIG. 2B, all of the pilot lines 27 may be connected to the control valve 17 via the shuttle valve 32. In other words, according to one feature, the pilot pressures corresponding to the operation contents related to all of the operation elements of the operating device 26 may be input to the control valve 17 via the shuttle valve 32.

The shuttle valve 32 includes 2 input ports, and 1 output port, and outputs to the output port the hydraulic oil having a higher pilot pressure between the pilot pressures input to the 2 input ports. One of the 2 input ports of the shuttle valve 32 is connected to the operating device 26 (more particularly, the above noted levers 26A and 26B, or the pedal 26C included in the operating device 26), and the other of the 2 input ports is connected to a proportional valve 31. The output port of the shuttle valve 32 is connected to a pilot port of a corresponding control valve (more particularly, a control valve corresponding to the hydraulic actuator that is an operating target of the levers 26A and 26B or the pedal 26C connected to one of the input ports of the shuttle valve 32) within the control valve 17, via the pilot line. For example, the excavator 500 includes shuttle valves 32 corresponding to each of the levers 26A and 26B that operate the boom 4 (the boom cylinder 7), the arm 5 (the arm cylinder 8), and the bucket 6 (the bucket cylinder 9). In this case, the output ports of these shuttle valves 32 are connected to the control valves respectively corresponding to the boom cylinder 7, the arm cylinder 8, and the bucket cylinder 9. For this reason, these shuttle valves 32 can respectively cause the higher one of the pilot pressure generated by the operating device 26 (levers 26A and 26B) and the pilot pressure generated by the proportional valve 31, to act on the pilot port of the corresponding control valve. In other words, the controller 30 that will be described later causes the proportional valve 31 to output the pilot pressure higher than the pilot pressure on the secondary side output from the operating device 26 (lever device), and can control the corresponding control valve regardless of the operator's operation with respect to the operating device 26, to control the operation of the attachment (at least one of the boom 4, the arm 5, and the bucket 6). Accordingly, the controller 30 can support the operator when operating the attachment, and enable a machine control function that autonomously (fully automatically) performs the construction operation.

With respect to the pedal 26C having the undercarriage 1 as the operating target, the pilot line 21 on the secondary side thereof may be connected to the corresponding control valve of the control valve 17, via the shuttle valve 32. Similar connections may be made with respect to the levers 26A and 26B having the slewing upper structure 3 as the operating target. Hence, similar to the case of the attachment, the controller 30 can control the corresponding control valve regardless of the operator's operation with respect to the operating device 26, to control the operation of the undercarriage 1 and the slewing upper structure 3.

A control system of the excavator 500 according to this embodiment includes the controller 30, a pressure sensor 29, the ECM 75, and an engine speed sensor 11*a*. In addition, the control system of the excavator 500 according to this embodiment includes, as structures related to a press restriction control and an operation stop control that will be described later, a pressure sensor 40, a position sensor 42, a camera 44, an operating state sensor 46, a display device 50, a speech output device 52, and a variable relief valve 54. Further, as illustrated in FIG. 2B, the control system of the excavator 500 according to this embodiment may include the proportional valve 31.

The controller 30 is an electronic control unit that drives and controls the excavator 500.

Functions of the controller 30 may be formed by arbitrary hardware, arbitrary software, or a combination of the hardware and the software. For example, the controller 30 may be formed by a microcomputer that includes a central processing unit (CPU), a read only memory (ROM), a random access memory (RAM), an input-output interface (I/O), or the like, and various functions may be performed by executing various programs stored in the ROM by the CPU.

For example, the controller 30 sets a target engine speed based on an operation mode or the like that is preset by a predetermined operation performed by the operator or the like, and drives and controls the engine 11 to undergo a constant rotation via the ECM 75. In addition, the controller 30 controls a hydraulic circuit that drives the hydraulic actuators including the control valve 17, based on detection values or the like, input from the pressure sensor 29, and corresponding to the operating states of the various operation elements (that is, the various hydraulic actuators) of the operating device 26.

Figure 3:
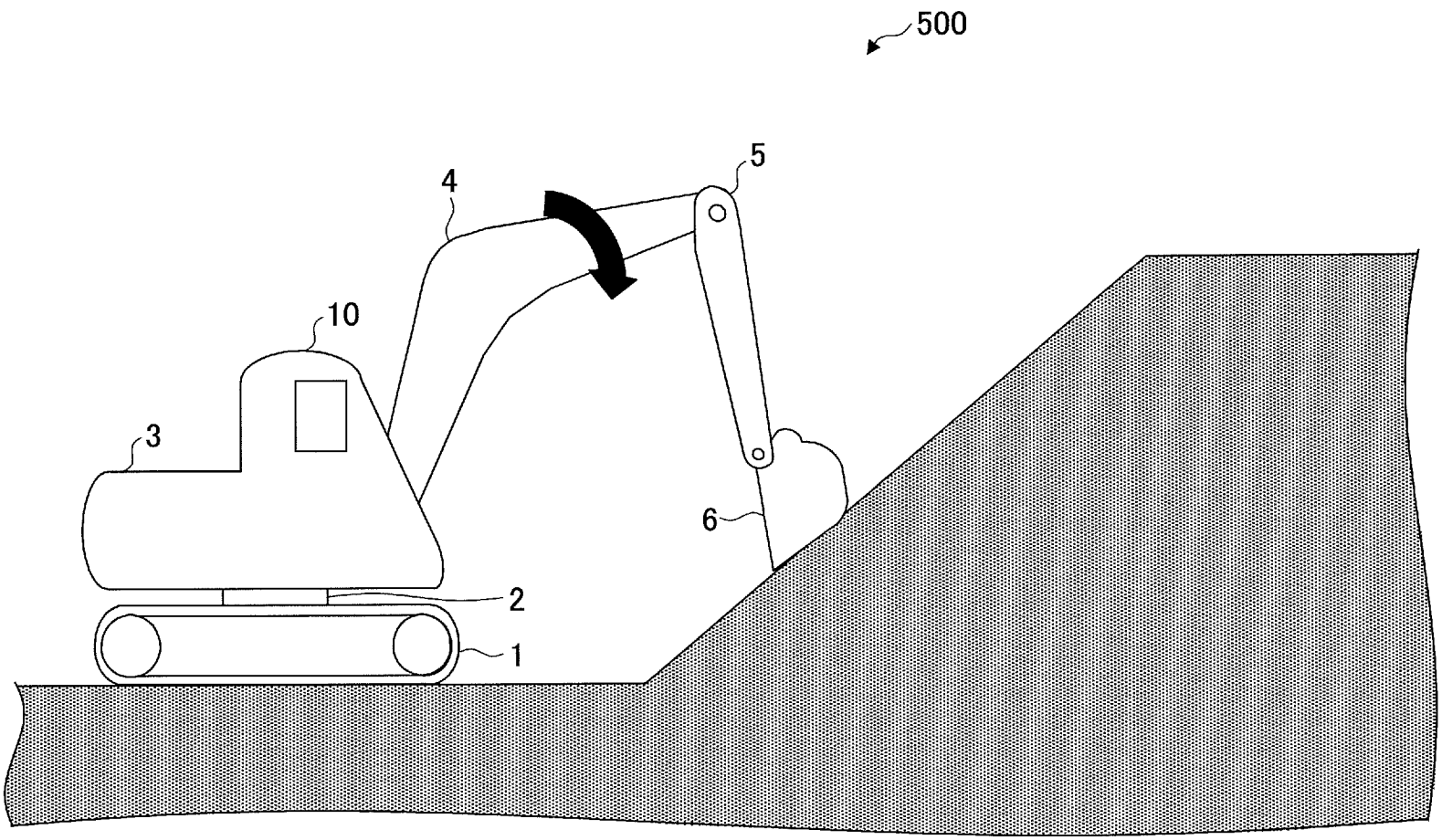
FIG. 3 is a diagram illustrating a particular example of a slope finishing operation of the excavator.

Moreover, when an operation to lower the boom 4 (operation indicated by an arrow in FIG. 3) is performed as illustrated in FIG. 3, and a finishing operation to prepare the slope (slope finishing operation) is performed by pressing a rear face of the bucket 6 with respect to the formed slope, for example, the controller 30 (an example of the control device) performs a control to support this slope finishing operation.

More particularly, the controller 30 performs a control to restrict a pressing force (hereinafter referred to as a "bucket pressing force") with which the bucket 6 is pressed against the slope during the slope finishing operation, a speed (hereinafter referred to as a "bucket lowering speed") with which the bucket 6 is lowered toward the ground immediately before pressing the bucket 6 against the slope, or the like. According to one feature, the control to restrict the bucket pressing force and the bucket lowering speed may be referred to as a "press restriction control" in the following. In addition, when the slope finishing operation is performed, the controller 30 performs a control to stop the slope finishing operation when the controller 30 judges that the slope may collapse. According to one feature, the control to stop the slope finishing operation may be referred to as an "operation stop control" in the following. In the following, the press restriction control and the operation stop control may be generally referred to as a "slope finishing support control". Details of the slope finishing support control will be described later.

Further, according to one feature, the controller 30 automatically operates the hydraulic actuators according to the operator's operation of the attachments with respect to the operating device 26, for example, to perform a control related to a machine control function (hereinafter referred to as a "support type machine control function") that supports a manual operation of the excavator by the operator. In addition, the controller 30 performs a control related to a machine control function (hereinafter referred to as an "autonomous machine control function") that autonomously operates the hydraulic actuators, regardless of the operator's operation of the attachments with respect to the operating device 26. In this case, the controller 30 controls the proportional valve 31 as noted above, to individually and automatically adjust the pilot pressure acting on the control valve corresponding to the respective hydraulic actuators. Hence, the controller 30 can automatically operate the respective hydraulic actuators, and perform the machine control function.

Moreover, the controller 30 may perform a combination of the slope finishing support control, and the control related to the machine control function, for example. More particularly, according to one feature, the controller 30 may automatically operate the attachments so that the rear face of the bucket 6 moves along a target forming surface corresponding to the target slope to be finished by the rear face of the bucket 6, for example, and while the excavator 500 is caused to perform a compaction operation (slope finishing operation), the press restriction control may be performed simultaneously, to restrict the bucket pressing force, the bucket lowering speed, or the like during the slope finishing operation. In other words, the controller 30 operates at least one of the boom 4, the arm 5, and the bucket 6, so as to press a predetermined portion (for example, the rear face) of the bucket 6 against the target forming surface, and move the predetermined portion of the bucket 6 along the target forming surface, while restricting the lowering operation of the boom 4 so that the bucket pressing force and the bucket lowering speed do not become relatively large. Because only the position of the bucket 6 is controlled by the machine control function, the slope may collapse, cave in, or the like, and the slope may not be finished appropriately, when the pressing force of the bucket 6 against the slope and the lowering speed of the bucket 6 toward the slope are too large. But by combining the slope finishing support control to the control related to the machine control function, it is possible to improve the quality of the slope finishing operation by the machine control function (refer to FIG. 4A and FIG. 4B), as will be described later. In the case of the operation stop control that will be described in the following, it is also possible to combine the control related to the machine control function.

A part of the functions of the controller 30 may be performed by another controller. That is, the functions of the controller 30 may be performed by a distributed processing on a plurality of controllers.

As noted above, the pressure sensor 29 is connected to the operating device 26 via the pilot line 28, and detects the pilot pressure on the secondary side of the operating device 26, that is, the pilot pressure corresponding to the operating state of the respective operation elements (hydraulic actuators) of the operating device 26. The pressure sensor 29 is communicably connected to the controller 30 via an in-vehicle network, such as a one-to-one communication line, controller area network (CAN), or the like, and detection signals of the pilot pressures corresponding to the operating states of the lower carriage 1, the clewing upper structure 3, the boom 4, the arm 5, the bucket 6, or the like of the operating device 26 are input to the controller 30.

The ECM 75 drives and controls the engine 11 based on a control command from the controller 30. For example, the ECM 75 generates a torque command for the engine 11, based on a measured value of the engine speed (rotational speed) of the engine 11 corresponding to a detection signal input from the engine speed sensor 11*a*, so that the engine 11 undergoes the constant rotation at the target engine speed corresponding to the control command from the controller 30. In addition, the ECM 75 outputs drive commands for generating a torque in the engine 11 in accordance with the generated torque command, to various actuators such as a fuel injection device or the like of the engine 11.

The engine speed sensor 11*a* is a known detection means for detecting the engine speed of the engine 11. The engine speed sensor 11*a* is communicably connected to the ECM 75 via the in-vehicle network, such as the one-to-one communication line, the CAN, or the like, and the detection signal corresponding to the engine speed of the engine 11 is input to the ECM 75.

The pressure sensor 40 is provided in a rod side oil chamber of the boom cylinder 7, for example, and is a known detection means for detecting an oil pressure (hereinafter simply referred to as a "rod pressure") in the rod side oil chamber of the boom cylinder 7. The pressure sensor 40 is communicably connected to the controller 30 via the in-vehicle network, such as the one-to-one communication line, the CAN, or the like, and a detection signal corresponding to the rod pressure of the boom cylinder 7 is acquired by the controller 30.

The position sensor 42 is provided on the boom cylinder 7, for example, and is a known detection means for detecting a position (hereinafter simply referred to as a "rod position") of the rod of the boom cylinder 7 along a reciprocating direction. The position sensor 42 is communicably connected to the controller 30 via the in-vehicle network, such as the one-to-one communication line, the CAN, or the like, and a detection signal corresponding to the rod position of the boom cylinder 7 is acquired by the controller 30.

The camera 44 is provided at the front lower portion or the like of the cabin 10, for example, and captures a predetermined range in front of the slewing upper structure 3, including the attachments. For example, the camera 44 captures the front of the slewing upper structure 3 for every predetermined period (for example, 1/30 second) during operation of the excavator 500, after an initializing process of the controller 30 ends when starting the excavator 500 until the excavator 500 stops (hereinafter simply referred to as "during the operation of the excavator 500"). The camera 44 is communicably connected to the controller 30 via the in-vehicle network, such as the one-to-one communication line, the CAN, or the like, and a captured image from the camera 44 is acquired by the controller 30.

The operating state sensor 46 detects an operating state of the vehicle (the undercarriage 1, the slewing upper structure 3, the attachments, or the like) of the excavator 500, more particularly, an inclination angle of the vehicle in a pitch direction. The operating state sensor 46 may include an inclination sensor, that is mounted on the slewing upper structure 3, for example, and detects inclination angles along 2 axes including front and rear directions and left and right directions of the excavator 500 (that is, the slewing upper structure 3). In addition, the operating state sensor 46 may include an angular velocity sensor, or a 3-axis inertial measurement unit (IMU) or the like capable of outputting 3-axis acceleration and 3-axis angular acceleration. The operating state sensor 46 is communicably connected to the controller 30 via the in-vehicle network, such as the one-to-one communication line, the CAN, or the like, and a detection signal corresponding to the inclination angle is acquired by the controller 30.

The display device 50 (an example of a notification device or means) is provided at a location near the operator's seat inside the cabin 10 (for example, a pillar portion at the front right inside the cabin 10), easily visible by the operator, and displays various information and images under a control of the controller 30. The display device 50 is a liquid crystal display or an organic electro luminescence (EL) display, for example, and may be a touchscreen panel integrally including an operation screen displayed in a display area, and an operating means. In the following description, it is assumed that the display device 50 is the touchscreen panel type display.

The speech output device 52 (an example of the notification device or means) is provided near the operator's seat inside the cabin 10, and outputs speech for making various notifications to the operator under a control of the controller 30. The speech output device 52 is a speaker, a buzzer, or the like, for example.

The variable relief valve 54 is provided in the high-pressure hydraulic line between the control valve 17 and the rod side oil chamber of the boom cylinder 7, and can restrict the pressure of the boom cylinder 7 to a predetermined relief pressure or lower, according to the control command input from the controller 30. The variable relief valve 54 is a solenoid proportional valve, for example, that is controlled by the control command from the controller 30 and activated/deactivated, and a relief pressure thereof is set to a command value included in the control command. Hence, the controller 30 can restrict the rod pressure of the boom cylinder 7, and control (restrict) the lowering operation of the boom 4, by outputting the control command to the variable relief valve 54. The lowering operation of the boom 4 may be controlled (restricted) by other methods. For example, among the pilot lines 27 connecting the operating device 26 and the control valve 17, the pilot line 27 corresponding to the lowering operation of the boom 4 (the boom cylinder 7) may be provided with a pressure reducing valve that is activated by the control command from the controller 30. In this case, because the pilot pressure input to the control valve 17 can be reduced from a pressure corresponding to the actual operating state of the operating device 26, according to the control command from the controller 30, it is possible to restrict the lowering operation of the boom 4.

The proportional valve 31 is provided in the pilot line that branches from the pilot line 25 and connects to the shuttle valve 32, and has a structure capable of varying a channel area (a cross sectional area through which the hydraulic oil can flow through) thereof. Accordingly, the proportional valve 31 can utilize the hydraulic oil of the pilot pump 15 supplied via the pilot line, and output a predetermined pilot pressure on the secondary side, to act on the other input port of the shuttle valve 32. For example, when the shuttle valves 32 corresponding to each of the boom 4 (the boom cylinder 7), the arm 5 (the arm cylinder 8), and the bucket 6 (the bucket cylinder 9) are provided as noted above, a corresponding proportional valve 31 is provided for each of the shuttle valves 32. The proportional valve 31 becomes active according to the control command input from the controller 30. Hence, even when the operating device 26 (more particularly, the levers 26A and 26B) are not operated by the operator, the controller 30 can supply the hydraulic oil ejected from the pilot pump 15 to the pilot port of the control valve, corresponding to the operation of the attachment (the boom 4, the arm 5, or the bucket 6), within the control valve 17, via the proportional valve 31 and the shuttle valve 43.

[Details of Structure of Slope Finishing Support Control Device]

Next, details of a structure of a slope finishing support control device 200 that performs the slope finishing support control, will be described by referring to FIG. 2A and FIG. 2B.

The slope finishing support control device 200 includes the controller 30, the pressure sensor 29, the pressure sensor 40, the position sensor 42, the camera 44, the display device 50, the speech output device 52, and the variable relief valve 54.

The controller 30 includes, as functional sections related to the slope finishing support control, an operating state judging section 301, a press reaction force judging section 302, a press restriction control section 303, and an operation stop control section 304.

The operating state judging section 301 judges the operating state of the excavator 500.

For example, the operating state judging section 301 judges whether the excavator 500 is performing the slope finishing operation.

Particularly, the operating state judging section 301 may judge whether the excavator 500 is performing the slope finishing operation, based on the captured image from the camera 44. More particularly, the operating state judging section 301 may perform the judgment by implementing a discriminator or the like that is subjected to a machine learning in advance so as to be able to judge whether the excavator 500 is performing the slope finishing operation, based on attitude states of the attachments, the existence of the slope, or the like included in the captured image from the camera 44.

In addition, the operating state judging section 301 may judge whether the excavator 500 is performing the slope finishing operation, based on the measured value of the rod pressure detected by the pressure sensor 40. More particularly, the operating state judging section 301 may perform the judgment by implementing a discriminator or the like that is subjected to a machine learning in advance so as to be able to judge whether the excavator 500 is performing the slope finishing operation, based on the measured value of the rod pressure, a state of change of the measured value of the rod pressure, or the like while the excavator 500 performs the slope finishing operation.

For the sake of simplicity, the case where the operating state judging section 301 judges that the excavator 500 is performing the slope finishing operation, may be referred to as "while the excavator 500 performs the slope finishing operation" in the following.

In addition, the operating state judging section 301 judges whether a lifting action of the excavator 500 occurred, for example.

Particularly, the operating state judging section 301 may judge whether the lifting action of the excavator 500 occurred, based on the detection result of the operating state sensor 46. More particularly, the operating state judging section 301 may judge whether the lifting action of the excavator 500 occurred, based on the information, that is related to the inclination angle of the vehicle of the excavator 500 in the pitch direction, and output from the operating state sensor 46.

The operating state judging section 301 may judge whether the floating operation of the excavator 500 is about to occur. In this case, the operating state judging section 301 may utilize the angular acceleration, the angular jerk, or the like in the pitch direction based on the information, that is related to the inclination angle of the vehicle of the excavator 500 in the pitch direction, and is output from the operating state sensor 46, to judge whether the floating operation of the excavator 500 is about to occur.

The press reaction force judging section 302 judges whether the reaction force from the ground (the slope) with respect to the bucket 6 became relatively small, more particularly, whether the reaction force became a predetermined reference or smaller. This predetermined reference corresponds to the reaction force that may act on the bucket 6 from the slope when the slope becomes fragile and there are signs of collapse.

For example, the press reaction force judging section 302 judges whether the reaction force from the target object with respect to the bucket 6 became the predetermined reference or smaller, based on a change in the measured value of the rod pressure of the boom cylinder 7 detected by the pressure sensor 40. More particularly, the press reaction force judging section 302 may judge that the reaction force became the predetermined reference or smaller, when a transition is made from a state where the rod pressure of the boom cylinder 7 is normal during the slope finishing operation, to a state where the rod pressure is relatively low and corresponds to the predetermined reference noted above, and the latter state continues.

For the sake of simplicity, the case where the press reaction force judging section 302 judges that the reaction force from the slope with respect to the bucket 6 became the predetermined reference or smaller, may be referred to as "when the reaction force from the slope with respect to the bucket 6 became the predetermined reference or smaller".

The press restriction control section 303 specifically performs the press restriction control.

For example, the press restriction control section 303 controls (restricts) the lowering operation of the boom 4, so that the bucket pressing force or the bucket lowering speed immediately before the pressing does not become relatively large. Particularly, the press restriction control section 303 restricts the lowering operation of the boom 4, so that the bucket pressing force or the bucket lowering speed becomes a predetermined upper limit value UL1 (an example of a first upper limit value) or less. More particularly, the press restriction control section 303 outputs the control command that sets the release pressure to a predetermined threshold value Pth1 to the variable relief valve 54, to activate the variable relief valve 54, so that the rod pressure of the boom cylinder 7 becomes the predetermined threshold value Pth1, corresponding to the upper limit value UL1, or less. Hence, because the upper limit value UL1 and the threshold value Pth1 are suitably set to the slope finishing support control device 200, the slope finishing support control device 200 can reduce a situation where the slope collapses due to the excessive pressing force on the bucket 6, when pressing the bucket 6 against the slope by the lowering operation of the boom 4. In addition, the slope finishing support control device 200 can reduce a situation where the lifting action of the excavator 500 occurs due to the excessive pressing force on the bucket 6, when pressing the bucket 6 against the slope by the lowering operation of the boom 4. For this reason, it is unnecessary for the operator to find a suitable operating state according to a state of an operation site, such as the hardness of the ground or the like, for the purposes of preventing the collapse of the slope, the lifting action of the excavator, or the like. Accordingly, the slope finishing support control device 200 can appropriately perform the slope finishing operation, while maintaining the workability.

Further, the press restriction control section 303 may vary the bucket pressing force or the direction of the bucket lowering speed (hereinafter "restricting direction"), as a restriction target, according to the operation input by the operator or the like, the angle of the actual slope, or the like (refer to FIG. 5B). This is because the force actually acting on the slope from the bucket 6 is a force in a direction perpendicular to the slope. In this case, the press restriction control section 303 may control the bucket pressing force or the bucket lowering speed in accordance with the angle of the slope, by controlling the operation of the arm 5 and the bucket 6 in addition to the lowering operation of the boom 4, that is, by controlling the overall operation of the attachments. In other words, the press restriction control section 303 may control only the operation of the boom 4, and restrict the bucket pressing force or the bucket lowering speed, or alternatively, control the overall operation of the elements other than the boom 4, and restrict the bucket pressing force or the bucket lowering speed.

The press restriction control section 303 may restrict the lowering operation of the boom 4, so that both the bucket pressing force and the bucket lowering speed do not become relatively large. In other words, the press restriction control section 303 may restrict the lowering operation of the boom 4, so that at least one of the bucket pressing force and the bucket lowering speed does not become relatively large. In addition, when the lowering operation of the boom 4 is restricted by the press restriction control, the controller 30 may control the display device 50 and the speech output device 52, to notify the operator that the lowering operation of the boom 4 is restricted. In this case, the controller 30 can reduce a strange feeling experienced by the operator when the lowering operation of the boom 4 is restricted.

The functions of the press restriction control section 303, that is, the functions related to the press restriction control, may be constantly valid for the duration from the start to the stop of the excavator 500. In addition, according to one feature, the functions of the press restriction control section 303 may make transitions between the valid state and invalid state. In other words, according to one feature, the controller 30 may include a press restriction invalid mode (an example of a first mode) in which the press restriction control is invalid, and a press restriction valid mode (an example of a second mode) in which the press restriction control is valid, as control modes, and make control mode transitions between the press restriction invalid mode and the press restriction valid mode. In this case, the controller 30 may make the transition from the press restriction invalid mode to the press restriction valid mode, or from the press restriction valid mode to the press restriction invalid mode, according to the operator's operation. Moreover, the controller 30 may make the transition from the press restriction invalid mode to the press restriction valid mode when the excavator 500 changes from a state where no slope finishing operation is performed to a state where the slope finishing operation is performed, and make the transition from the press restriction valid mode to the press restriction invalid mode when the excavator 500 changes from the state where the slope finishing operation is performed to the state where no slope finishing operation is performed. In other words, the controller 30 makes the transitions between the press restriction invalid mode and the press restriction valid mode, based on the measured value of the rod pressure detected by the pressure sensor 40, the captured image from the camera 44, or the like.

Figure 4A:
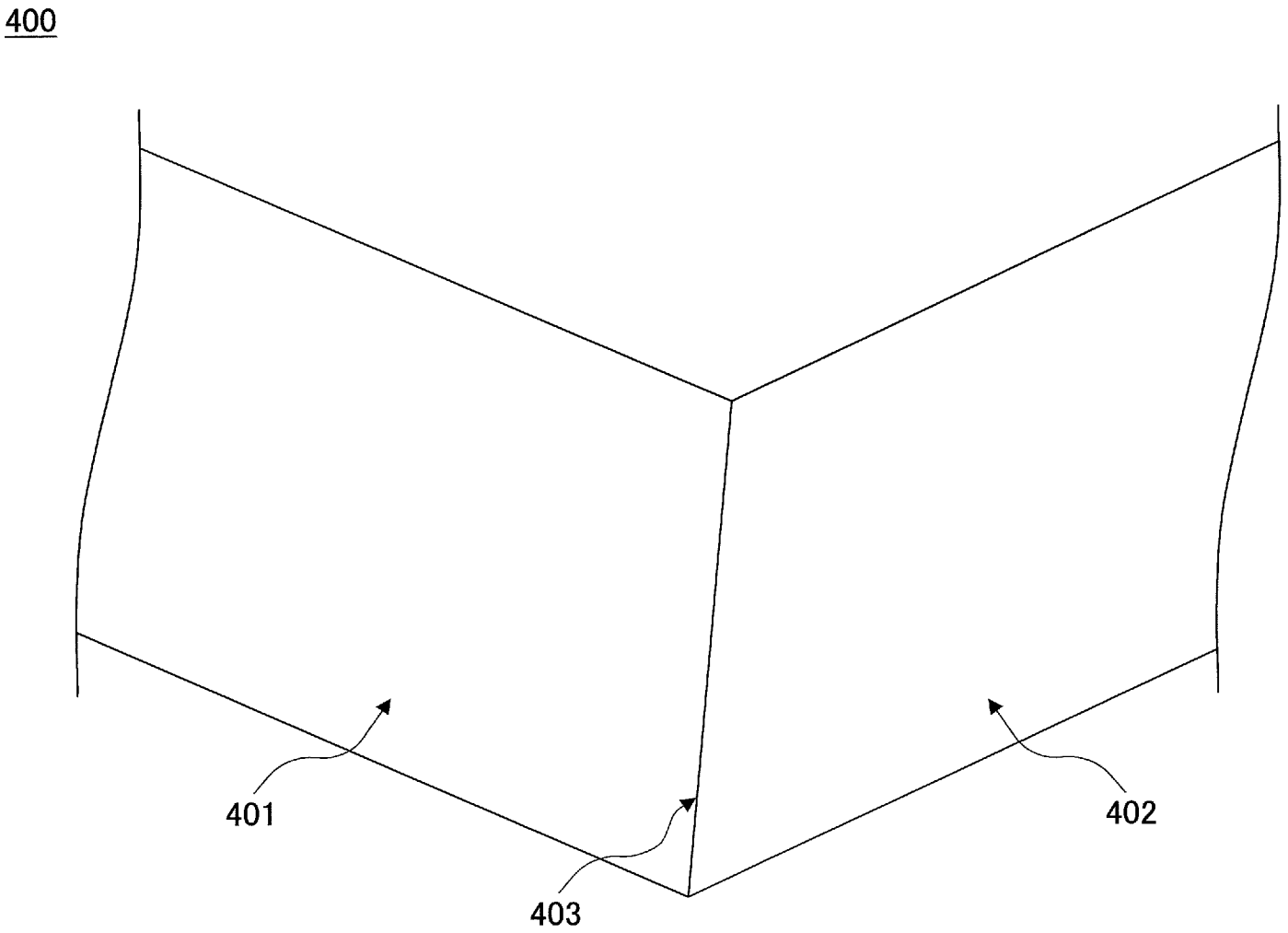
FIG. 4A is a diagram for explaining effects of applying a press restriction control in the slope finishing operation.
Figure 4B:
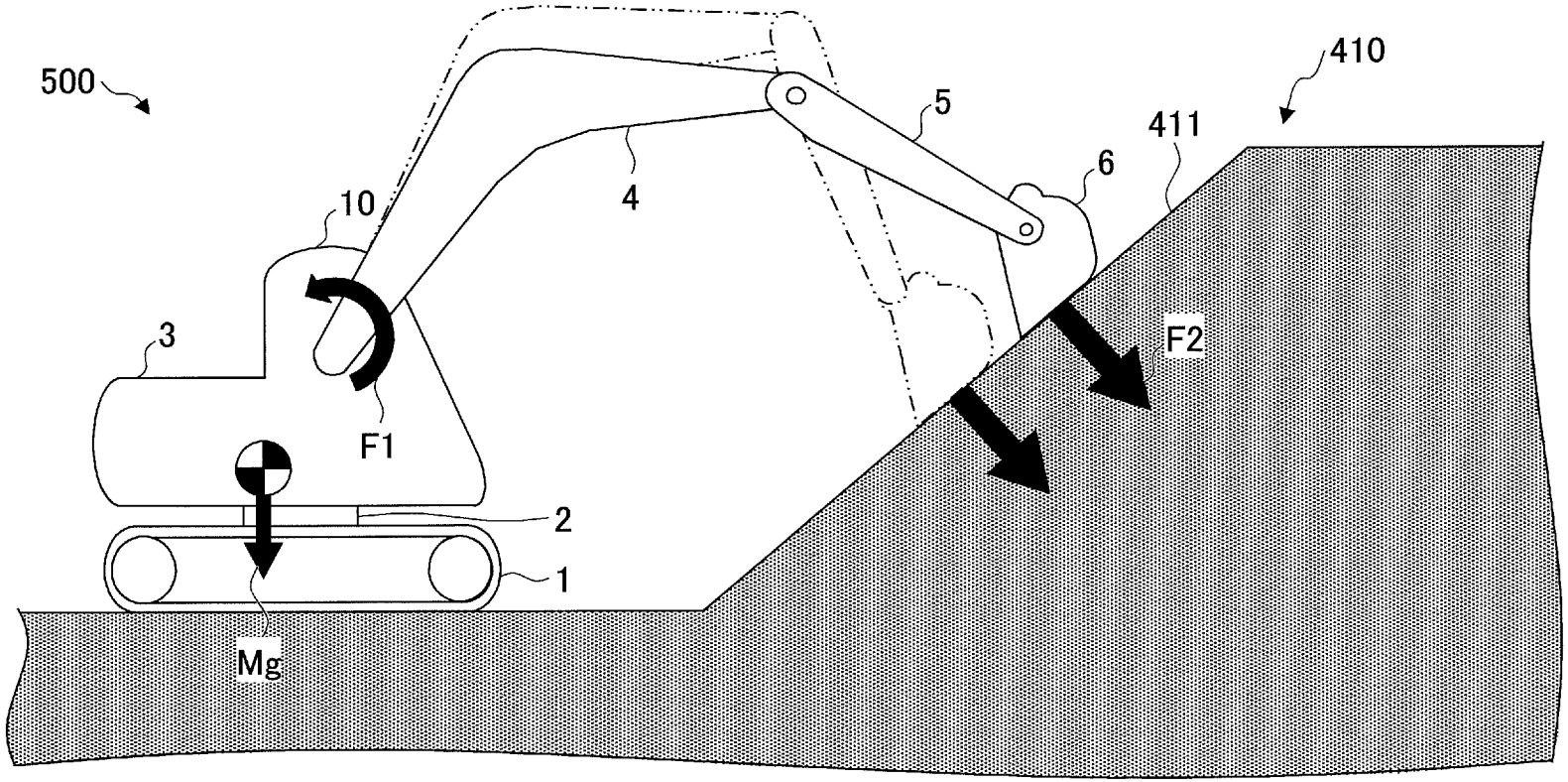
FIG. 4B is a diagram for explaining the effects of applying the press restriction control in the slope finishing operation.

For example, FIG. 4A and FIG. 4B are diagrams for explaining effects of applying the press restriction control in the slope finishing operation. More particularly, FIG. 4A is a diagram illustrating an example of the slope that is a target of the slope finishing operation, and FIG. 4B is a diagram for explaining the lifting action of the excavator 500 that may occur during the slope finishing operation.

As illustrated in FIG. 4A, in a reclaimed area 400 by banking, a plurality of slopes 401 and 402 may be formed at ends of the bank portion.

Particularly, portions of the slopes 401 and 402 in a vicinity of a corner 403 where the adjacent slopes 401 and 402 join, require a careful operation because these portions easily collapse due to the pressing force of the bucket 6 during the slope finishing operation.

In such a state, the press restriction control section 303 restricts the lowering operation of the boom 4, so as to reduce a situation where the pressing force on the bucket 6 becomes excessively large during the slope finishing operation and causes the slopes 401 and 402, particularly in the vicinity of the corner 403, to collapse.

In addition, as illustrated in FIG. 4B, the excavator 500 performs the slope finishing operation on a slope 411, as a target, formed at the end of the bank portion of a reclaimed area 410 by banking, and a pressing force F2 acts toward the slope 411 from the bucket 6. In this state, a force F1 (moment of force) corresponding to the reaction force of the force F2, acting on the bucket 6, acts on the vehicle (the slewing upper structure 3) of the excavator 500 via the attachments so as to tilt the vehicle rearward. When the moment of force, corresponding to the force F1 that acts on the vehicle to tilt the vehicle rearward, exceeds a moment of force that holds the vehicle down on the ground by a gravitational force Mg, the front of the vehicle is lifted up. In addition, depending on a state of the operation site, the rear of the vehicle may be lifted up.

Even in such a state, the press restriction control section 303 can reduce the case where the lifting action of the excavator 500 occurs due to the excessive pressing force on the bucket 6, caused by the reaction force from the slope with respect to the excavator 500 during the slope finishing operation, by restricting the lowering operation of the boom 4.

Returning to the description of FIG. 2A and FIG. 2B, the press restriction control section 303 sets a control condition (hereinafter a "press restriction control condition") for restricting the lowering operation of the boom 4 during the press restriction control. For example, the press restriction control condition is the upper limit value UL1 noted above. The press restriction control section 303 may automatically set the press restriction control condition, according to the operating state of the excavator 500, the state of the operation site, or the like, for example. In this case, the operating state of the excavator 500, the state of the operation site, or the like may be judged based on the captured image from the camera 44, and the detection information from the operating state sensor 46. In addition, the press restriction control section 303 may set the press restriction control condition according to the operator's operation.

The upper limit value UL1 corresponding to the press restriction control condition is a default value (an initial setting), that is an initial condition (an initial value) and a recommended condition (a recommended value), and according to one feature, the upper limit value UL1 may be stored in an internal memory or the like of the controller 30. In this case, the upper limit value UL1 may be automatically set to the default value by the controller 30. In addition, according to one feature, the upper limit value UL1 may be settable by the operator, and according to one feature, may be settable by the operator who makes a change using the default value as a reference. In this case, an operation screen (hereinafter "upper limit value setting screen") for setting the upper limit value UL1 may be displayed on the display device 50. Further, the upper limit value UL1 may be set by operating the upper limit value setting screen, according to an operation input to the touchscreen panel of the display device 50, or other operation sections of the display device 50 formed by hardware, such as button switches or the like. A setting operation of an upper limit value UL2, a cancel operation of the upper limit values UL1 and UL2, or the like, that will be described later in the following, may be performed similar to the above. Moreover, according to one feature, the upper limit setting screen displayed on the display device 50 may display a numerical value of the upper limit value UL1, change the displayed numerical value according to an operation performed on the touchscreen panel or the like of the display device 50, and validate the setting according to an enter operation performed by the operator on the touchscreen panel or the like. In addition, according to one feature, the upper limit value setting screen displayed on the display device 50 may display a bar graph corresponding to the upper limit value UL1, change the length of the bar graph corresponding to the upper limit value UL1 according to the operation performed by the operator on the touchscreen panel or the like of the display device 50, and validate the setting according to the enter operation performed by the operator on the touchscreen panel or the like. In the following, it is assumed by the setting operation of the upper limit value UL2 is similar to the above.

In addition, the upper limit value UL1 may be selected from a plurality of prescribed candidate conditions, that is, candidate values. The candidate values of the upper limit value UL1 may be prescribed by taking into consideration the workability of the excavator 500 and the performance of the slope finishing operation, for example. More particularly, the candidates of the upper limit value UL1 may include a first candidate value according to one feature that prioritizes the workability of the excavator 500 and is relatively large, a second candidate value according to one feature that balances the workability of the excavator 500 and the performance of the slope finishing operation and is moderate, and a third candidate value according to one feature that prioritizes the performance of the slope finishing operation and is relatively small, for example. In this case, according to one feature, the controller 30 may automatically select one candidate value for the upper limit value UL1 from the plurality of candidate values, by taking into consideration the operating state of the excavator 500 (for example, whether the operator performs the operation that prioritizes the workability, the performance of the operation, or the like), and the state of the operation site (for example, the hardness of the slope, or the like). Further, one candidate value may be selected for the upper limit value UL1 from the plurality of candidate value, according to the operator's operation. Particularly, similar to the above, the upper limit value setting screen may be displayed on the display device 50, and one candidate value may be selected from the plurality of candidate values according to the operation performed with respect to the upper limit value setting screen. More particularly, the upper limit value setting screen may display button icons respectively corresponding to the plurality of candidate values, and one candidate value corresponding to one of the button icons may be selected, according to the operation performed on the touchscreen panel or the like of the display device 50.

According to one feature, a relational expression, map, or the like of a corresponding relationship between the upper limit value UL1 and the threshold value Pth1, that may vary according to the operator's operation or the automatic setting, may be prestored in the internal memory or the like of the controller 30. Accordingly, the press restriction control section 303 can control the variable relief valve 54, based on the upper limit value UL1, and the information related to the corresponding relationship prestored in the internal memory or the like of the controller 30, and suitably restrict the lowering operation of the boom 4. In the following, it is assumed by the corresponding relationship between the upper limit value UL2, and a threshold value Pth2 that will be described later, is similar to the above.

Figure 5A:
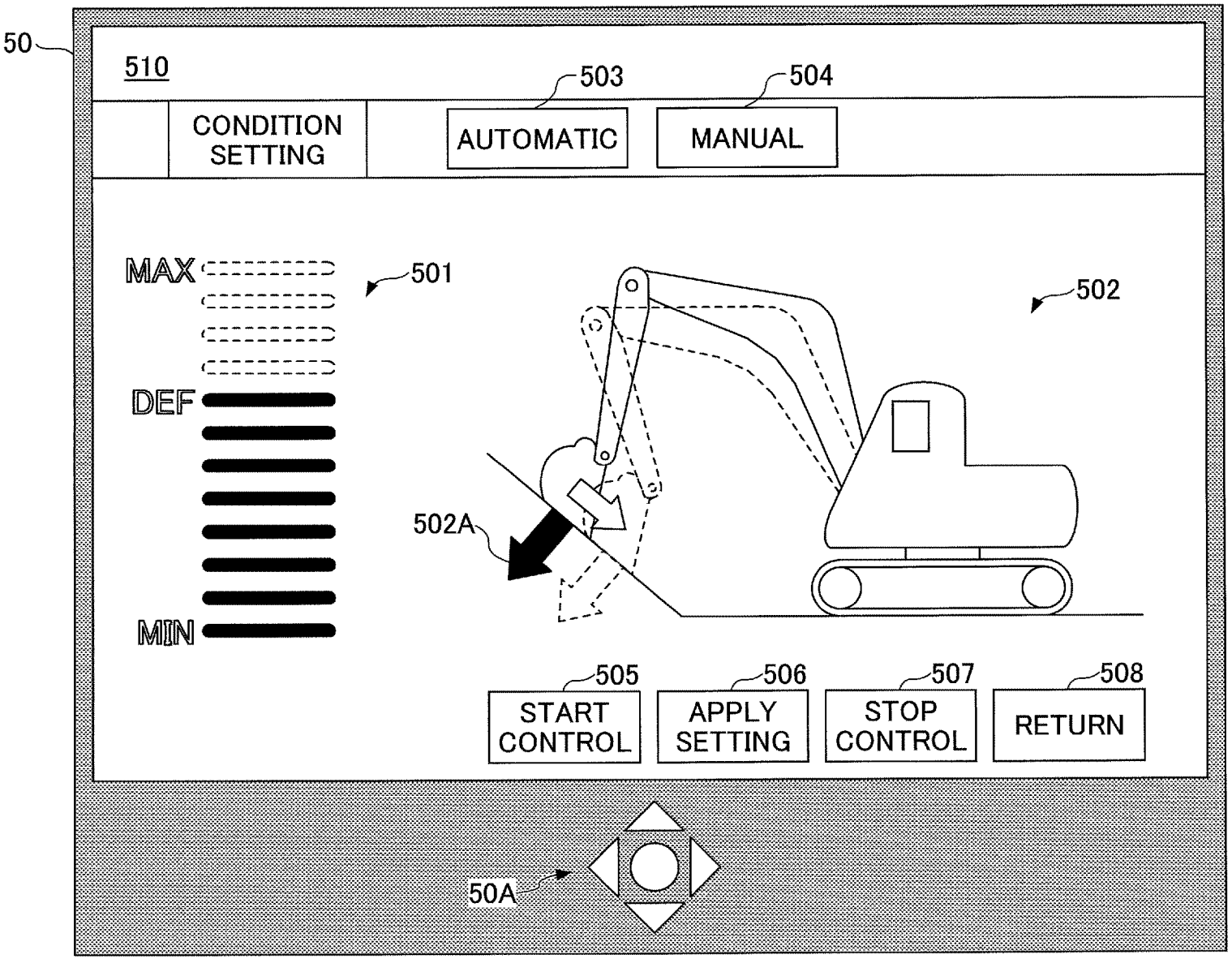
FIG. 5A is a diagram illustrating an example of a setting screen, that is displayed on a display device, and sets a control condition related to the press restriction control.

For example, FIG. 5A is a diagram illustrating an example of the setting screen (a setting screen 510), that is displayed on the display device 50, and sets the control condition (the press restriction control condition) related to the press restriction control.

As illustrated in FIG. 5A, the setting screen 510 displayed on the display device 50 displays a bar graph 501 indicating the upper limit value UL1 that is an example of the press restriction control condition, and an excavator image 502 indicating supplemental explanation of the press restriction control condition of the bar graph 501.

A dashed line portion of the bar graph 501 represents a portion that is not displayed in the current setting state.

According to one feature, the bar graph 501 is arranged to extend in up and down directions at a left end of the setting screen 510. Characters "MIN" indicating the settable lower limit value, characters "MAX" indicating the settable upper limit value, and characters "DEF" indicating the default value, are respectively indicated on the left of the bar graph 501. This example illustrates a state where the upper limit value UL1 is set to the default value.

According to one feature, the setting of the press restriction control condition (the upper limit value UL1) indicated by the bar graph 501 may be changeable by an operator's touch operation with respect to the portion of the bar graph 501 on the setting screen 510 displayed on the touchscreen panel type display device 50, for example. More particularly, according to one feature, the operator may touch an upper end position corresponding to the upper limit value UL1 of the bar graph 501, and make a slide operation in the up and down directions while maintaining the touch, to change the upper end position of the bar graph 501 in the up and down directions.

In addition, according to one feature, the setting of the press restriction control condition (the upper limit value UL1) indicated by the bar graph 501 may be changeable by the operator's operation with respect to a button switch 50A that is implemented in the display device 50, for example. More particularly, the operator may select the bar graph by a direction indicator button indicating left and right directions on the button switch 50A, and operating an enter button at a center of the button switch 50A in a state where the bar graph 501 is selected. As a result, an active state is reached where the operation to change the control condition indicated by the bar graph 501 is possible. The operator, according to one feature, may be able to change the upper end position of the bar graph 501 up and down, using a direction indicator button indicating the up and down directions on the button switch 50A.

Moreover, the upper limit value UL1 may be automatically set to the default value by an operation specifying the portion of the characters "DEF" (for example, a touch operation with respect to the portion of the characters "DEF" of the touchscreen panel implemented in the display device 50). Further, the candidate value, other than the default value, may be prescribed for the upper limit value UL1. In this case, character information corresponding to the candidate value may be indicated at a position corresponding to the candidate value in the bar graph 501, and the upper limit value may be automatically set to the candidate value by performing an operation to specify the portion of the character information.

According to one feature, the excavator image 502 is indicated on the right adjacent to the bar graph 501, and schematically illustrates the slope finishing operation of the excavator 500. More particularly, the excavator image 502 indicates a manner in which the bucket moves along the slope according to the operation of the attachments (the attachment portions indicated by the solid line and the dashed line in the excavator image 502 in FIG. 5A). Accordingly, the operator can easily recognize that the setting screen 510 is the screen for setting the press restriction control condition.

In addition, a black arrow 502A, indicating a state where the bucket 6 applies a pressing force against the slope (that is, the excavator 500 is performing compaction of the slope) is displayed near the bucket in the excavator image 502. Hence, the operator can easily recognize that the setting screen 510 is the screen for setting the press restriction control condition.

Further, the arrow 502A may be variable according to the setting state of the upper limit value UL1. For example, according to one feature, the arrow 502A may become longer as the upper limit value UL1 becomes larger, and become shorter as the upper limit value UL1 becomes smaller. In addition, the arrow 502A may vary according to (that is, in a manner linked to) the display state of the bar graph 501, for example. More particularly, according to one feature, the arrow 502A may become longer as the upper end position of the bar graph 501 moves further upward, and become shorter as the as the upper end position of the bar graph 501 moves further downward. Hence, from the length of the arrow 502A, the operator can intuitively comprehend the extent of restricting the lowering operation of the boom 4 by the press restriction control. Moreover, the upper limit value UL1 may be settable by an operator's touch operation with respect to the portion of the arrow 502A in the setting screen 510 of the touchscreen panel type display device 50, for example. More particularly, according to one feature, the operator may touch a tip end position of the arrow 502A, and make a slide operation toward the tip end side or a base end side while maintaining the touch, so that the upper limit value UL1 is settable by varying the length of the arrow 502A.

Further, buttons 503 and 504, that are virtual operating targets, are arranged side by side on the left and right, at an upper end portion of the setting screen 510.

The buttons 503 and 504 are operating parts for selecting a method of switching a control mode related to the press restriction control of the controller 30, that is, the method of switching between a press restriction invalid mode and a press restriction valid mode.

The button 503 is the operating part for selecting the automatic switching between the press restriction invalid mode and the press restriction valid mode. For example, when the button 503 is operated via the touchscreen panel implemented in the display device 50, the automatic switching is performed between the press restriction invalid mode and the press restriction valid mode, according to a predetermined condition. In this case, even when an operation is performed with respect to the buttons 503 and 505 to be described later, that are operating parts for validating and invalidating the press restriction control, a state where the operation is invalidated, or the operation itself with respect to the buttons 503 and 505 is not be accepted (for example, a greyed out display state of the buttons 503 and 505), may occur.

The button 504 is the operating part for selecting a manual switching between the press restriction invalid mode and the press restriction valid mode. For example, when the button 504 is operated via the touchscreen panel implemented in the display device 50, the manual switching is performed between the press restriction invalid mode and the press restriction valid mode.

In addition, buttons 505 through 508, that are virtual operating targets, are arranged side by side in the left and right directions, at a lower end portion of the setting screen 510.

The button 505 is the operating part that validates the control condition set on the setting screen 510 and starts the press restriction control, that is, causes a transition of the control mode of the controller 30 from the press restriction invalid mode to the press restriction valid mode. Hence, the operator can start the press restriction control under the control condition set on the setting screen 510.

The button 506 is the operating part that applies the control condition set on the setting screen 510. Hence, when the operator desires to change the control condition according to the state of the site or the like, in a situation where the press restriction control is already started, for example, the operator can make the change to the appropriate control condition before continuing the press restriction control.

The button 507 is the operating part that cancels the control condition set on the setting screen 510 and stops the press restriction control, that is, causes a transition of the control mode of the controller 30 from the press restriction valid mode to the press restriction invalid mode. Hence, the operator can stop the press restriction control based on the operator's judgment.

The button 508 is the operating part that returns the screen from the setting screen 510 to a predetermined main screen. Hence, the operator can cause a transition of the display on the display device 50 from the setting screen 510 to the main screen or the like, such as when the operator changes the operator's mind and decides that no change is required in the setting of the control condition, for example.

The bar graph 501, and the selecting operation among the buttons 505 through 508, may be performed by the operator's touch operation to the touchscreen panel, or the operation of the direction indicator button indicating the left and right directions on the button switch 50A and the operation of the enter button.

In this example (FIG. 5A), the operating parts (the buttons 503 and 505) for starting and stopping the press restriction control are provided in the control condition setting screen, however, these operating parts may be provided in a separate screen unrelated to the setting of the control condition. In addition, a button switch or the like, that can start and stop the press restriction control, may be provided regardless of the display on the display device 50.

Figure 5B:
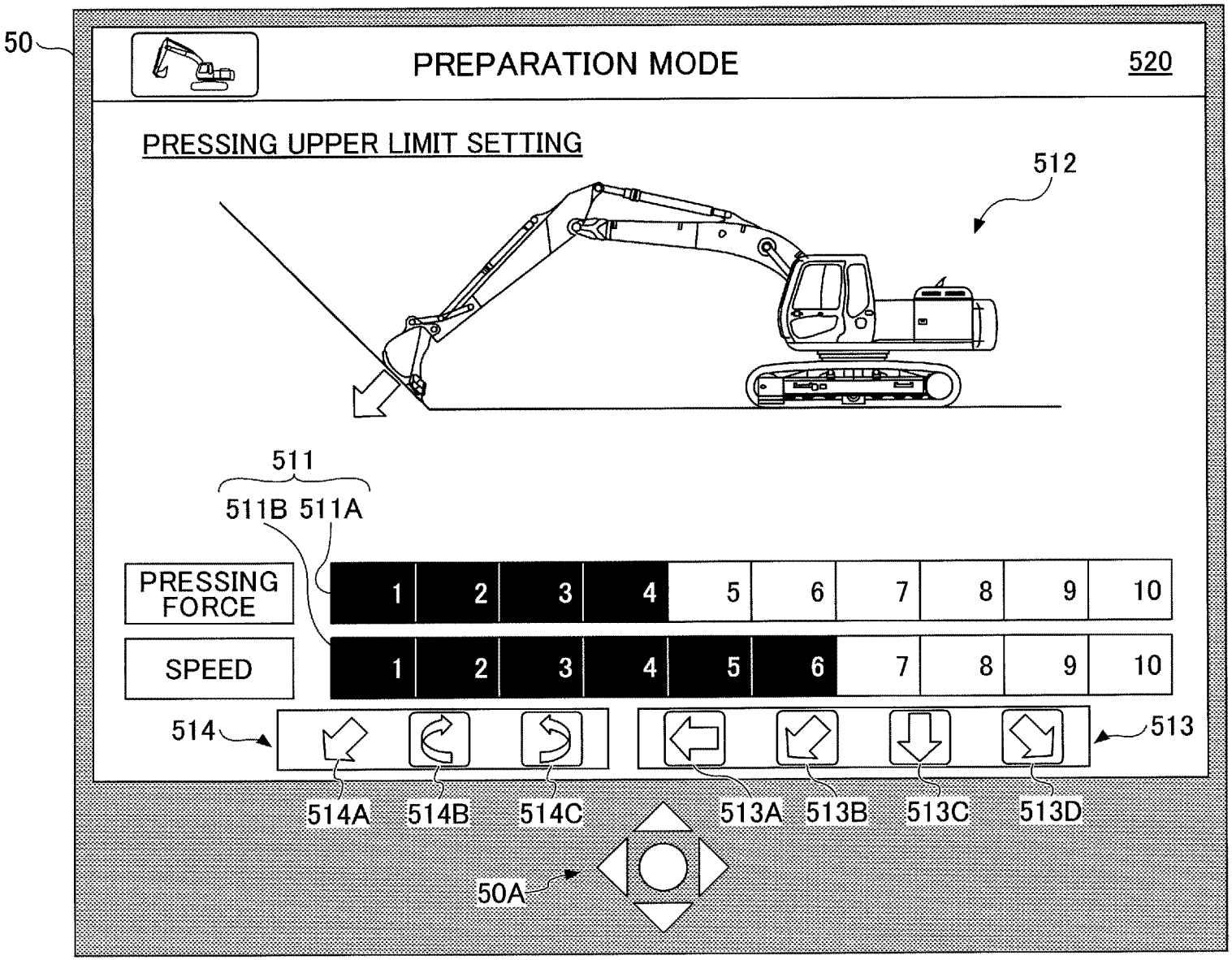
FIG. 5B is a diagram illustrating the example of the setting screen, that is displayed on the display device, and sets the control condition related to the press restriction control.

Further, FIG. 5B is a diagram illustrating another example of the setting screen (a setting screen 520), that is displayed on the display device 50, and sets the control condition (the press restriction control condition) related to the press restriction control.

As illustrated in FIG. 5B, the setting screen 520 displayed on the display device 50 displays a bar graph 511 indicating the upper limit value UL1 that is an example of the press restriction control condition, and an excavator image 512 indicating supplemental explanation of the press restriction control condition of the bar graph 511.

According to one feature, the bar graph 511 is arranged to extend to the left and right in a lower half region of the setting screen 510. The bar graph 511 includes a bar graph 511A for setting the upper limit value UL1 of the pressing force of the bucket 6 against the slope, and a bar graph 511B for setting the upper limit value UL1 of the bucket lowering speed. According to one feature, the upper limit value UL1 of the bucket pressing force, and the upper limit value UL1 of the bucket lowering speed, may be settable independently. In addition, according to one feature, one of the upper limit value UL1 of the bucket pressing force, and the upper limit value UL1 of the bucket lowering speed, may have a corresponding relationship that depends on the other, such that when one of the upper limit values UL1 is set, the other of the upper limit values UL1 is automatically set from the corresponding relationship thereto.

In this example, each of the bar graphs 511A and 511B represents the upper limit value UL1 in 10 levels. In FIG. 5B, the upper limit value UL1 of the bucket pressing force corresponding to the bar graph 511A is set to a level 4 of the 10 levels, and the upper limit value UL1 of the bucket lowering speed corresponding to the bar graph 511B is set to a level 6 of the 10 levels.

According to one feature, the setting of the press restriction control conditions (the upper limit values UL1) indicated by the bar graphs 511A and 511B may be changeable, similar to the case of the bar graph 501 of FIG. 5A, by the operator's touch operation with respect to the portion of the bar graph 511 in the setting screen 520 of the touchscreen panel type display deice 50. In addition, according to one feature, the setting of the press restriction control condition (the upper limit values UL1) indicated by the bar graphs 511A and 511B may be changeable, similar to the case of the bar graph 501 of FIG. 5A, by the operator's operation with respect to the button switch 50A implemented in the display device 50, for example.

The excavator image 512 schematically illustrates the slope finishing operation of the excavator 500, similar to the excavator image 502 of FIG. 5A.

Further, operating icon groups 513 and 514, that are virtual operating targets, are arranged side by side on the right and left, at a lower end portion of the setting screen 520. The operating icon groups 513 and 514 are operating parts for setting the restricting direction as an example of the press restriction control condition.

The operating icon group 513 is the operating part for setting the restricting direction from a plurality of (4 in this example) candidate restricting directions. The operating icon group 513 includes icons 513A through 513D.

The icon 513A is the operating part for setting the restricting direction to a frontward direction when viewed from the operator of the excavator 500. For example, the icon 513A may be utilized when performing a compaction operation of an uphill slope, wall, or the like in having an extremely steep inclination in front of the excavator 500.

The icon 513B is the operating part for setting the restricting direction to a diagonally downward direction to the front when viewed from the operator of the excavator 500. For example, the icon 513B may be utilized when performing a compaction operation of an uphill slope having a moderate inclination in front of the excavator 500.

The icon 513C is the operating part for setting the restricting direction to a downward direction when viewed from the operator of the excavator 500. For example, the icon 513C may be utilized when performing a compaction operation of an uphill slope having an extremely gradual inclination or a horizontal surface in front of the excavator 500.

The icon 513D is the operating part for setting the restricting direction to a diagonally downward direction to the rear when viewed from the operator of the excavator 500. For example, the icon 513D may be utilized when performing a compaction operation of a downhill slope in front of the excavator 500, that is, a slope finishing operation from a hilltop side of the slope.

The operator can select (set) the more appropriate restricting direction for the slope that is the target of the operation, from the icons 514A through 514D, by suitably operating the touchscreen panel implemented in the display device 50 and the button switch 50A, for example.

The operating icon group 514 is the operating part for more finely adjusting the restricting direction. The operating icon group 514 includes icons 514A through 514D.

The icon 514A is an image of an arrow indicating the restricting direction that is currently set using the excavator image 512 as a reference. Hence, the operator can confirm the current restricting direction by utilizing the icon 514A.

The icons 514B and 514C are operating parts for adjusting the restricting direction in a right-hand turning (that is, a clockwise) direction and a left-hand turning (that is, a counterclockwise) direction, respectively. More particularly, when the icon 514B is operated via the touchscreen panel implemented in the display device 50 and the button switch 50A, the icon 514A rotates clockwise at predetermined angular steps in a manner linked to the operation performed on the icon 514B, thereby adjusting the restricting direction. Similarly, when the icon 514C is operated, the icon 514A rotates counterclockwise at predetermined angular steps in a manner linked to the operation performed on the icon 514C, thereby adjusting the restricting direction. Hence, the operator can more finely adjust the restricting direction.

Accordingly, in this example (FIG. 5B), the operator can set, via the setting screen 520, not only the upper limit value UL1 but also the restricting direction, as the press restriction control condition. For this reason, the press restriction control, more appropriate for the angle or the like of the slope that is the target of the operation, can be performed by requiring the operator to simply set the restricting direction.

Returning to the description of FIG. 2A and FIG. 2B, the operation stop control section 304 specifically performs the operation stop control.

For example, when the reaction force from the slope with respect to the bucket 6 becomes relatively small, that is, becomes or falls below a predetermined reference (hereinafter referred to as a "first reference") that is set to a relatively small value, the operation stop control section 304 further restricts the lowering operation of the boom 4 so that the bucket pressing force or the bucket lowering speed becomes relatively small (more particularly, becomes the upper limit value UL2 or less, where the upper limit value UL2 is smaller than the upper limit value UL1). Accordingly, in a situation where the reaction force from the slope becomes relatively small, that is, the ground becomes fragile and may collapse, the slope finishing operation can be stopped by strongly restricting the lowering operation of the boom 4. For this reason, it is possible to reduce a situation where the slope, that became fragile and is the target of the slope finishing operation, collapses.

Further, for example, when the reaction force from the slope with respect to the bucket 6 becomes relatively large, that is, exceeds a predetermined reference (hereinafter referred to as a "second reference") that is set to a relatively large value (set sufficiently larger than the first reference), the operation stop control section 304 further restricts the lowering operation of the boom 4 so that the bucket pressing force or the bucket lowering speed becomes relatively small (more particularly, becomes the above noted upper limit value UL2 or less). Accordingly, during the slope finishing operation, in a situation where the reaction force from the slope becomes relatively large due to rocks or the like within the earth and sand, that is, in a situation where cracks or the like originating from portions of the rocks are likely to occur in the slope due to a pressing force acting on the rocks within the earth and sand under the slope, it is possible to stop the slope finishing operation by greatly restricting the lowering operation of the boom 4. For this reason, the collapsing of the target slope to be finished, caused by the cracks or the like that are likely to occur due to the effects of the rocks or the like, can be reduced.

More particularly, the operation stop control section 304 outputs to the variable relief valve 54 the control command that sets the relief pressure to the threshold value Pth2 so that the rod pressure of the boom cylinder 7 becomes the predetermined threshold value Pth2 (<Pth1), corresponding to the upper limit value UL2, or less. Accordingly, the upper limit value UL2 and the threshold value Pth2 are suitably set to extremely small values, and more particularly, the lowering operation of the boom 4 is restricted so that the slope finishing operation cannot be continued, and it is possible to stop the slope finishing operation in the situation where the slope may collapse. For this reason, in the situation where the slope may collapse, it is possible to reduce the case where the slope collapses as a result of the slope finishing operation that is continued.

The operation stop control section 304 may perform the operation stop control only when the reaction force from the slope with respect to the bucket 6 becomes relatively small or becomes relatively large. In addition, the controller 30 may control the display device and the speech output device 52 when the lowering operation of the boom 40 is greatly restricted by the operation stop control, to notify the operator that the lowering operation of the boom 4 is greatly restricted and the slope finishing operation is stopped. In this case, the controller 30 can reduce the strange feeling experienced by the operator when the lowering operation of the boom 4 is restricted.

A default value may be prescribed for the upper limit value UL2, similar to the upper limit value UL1, and according to one feature, the upper limit value UL2 may be stored in the internal memory or the like of the controller 30. In addition, according to one feature, the upper limit value UL2 may be settable by the operator who makes a change using the default value as a reference. In this case, a setting screen similar to the above noted setting screen 510 (refer to FIG. 5A and FIG. 5B) for setting the control condition related to the press restriction control is displayed on the display device 50, and according to one feature, the control condition (the upper limit value UL2) related to the operation stop control may be settable by the operator.

[Details of Operation of Slope Finishing Support Control Device]

Next, a particular operation of the slope finishing support control device 200, that is, the particular process of the slope finishing support control that is performed, will be described by referring to FIG. 6A through FIG. 11B.

[Particular Examples of Press Restriction Control]

FIG. 6A through FIG. 8B are flow charts illustrating particular examples of the press restriction control performed by the controller 30. Ion the following the particular examples of the press restriction control of FIG. 6A through FIG. 8B may be suitably combined. For example, at least two processes may be performed in parallel among the particular examples of the press restriction control of FIG. 6A through FIG. 8B.

Figure 6A:
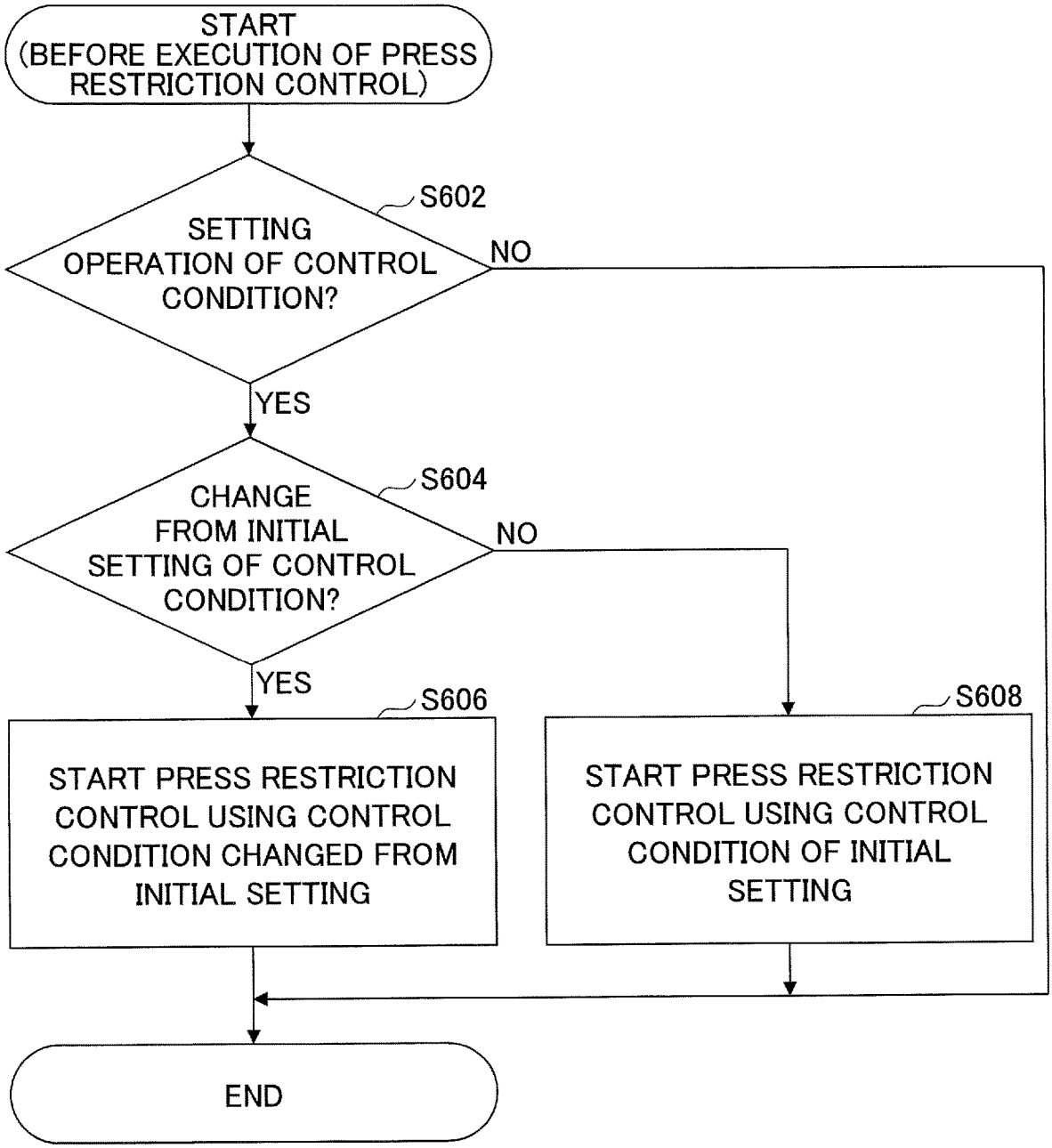
FIG. 6A is a flow chart schematically illustrating an example of the press restriction control performed by a controller.
Figure 6B:
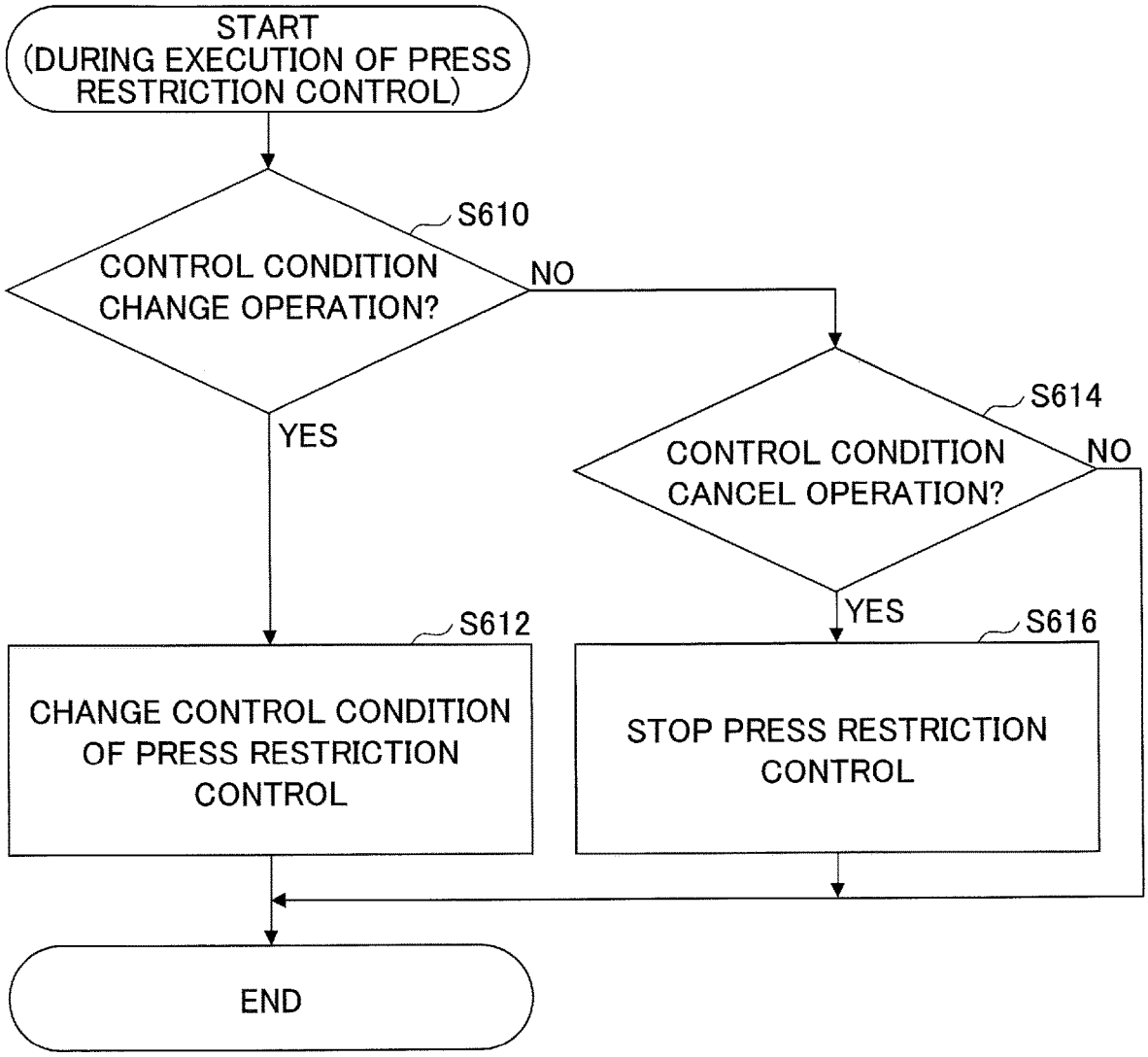
FIG. 6B is a flow chart schematically illustrating the example of the press restriction control performed by the controller.

First, FIG. 6A and FIG. 6B are the flow charts schematically illustrating an example of the press restriction control performed by the controller 30. More particularly, FIG. 6A and FIG. 6B respectively are the flow charts schematically illustrating the example of a process related to a start of the press restriction control, and process related to a change of the control condition of the press restriction control and a stop of the press restriction control, performed by the controller 30. The process of the flow chart of FIG. 6A is repeatedly performed for every predetermined control period, in a situation where the press restriction control is not performed during the operation of the excavator 500, for example. Processes of flow charts of FIG. 7A and FIG. 8A described later are performed in a similar situation. On the other hand, the process of the flow chart of FIG. 6B is repeatedly performed for every predetermined control period, in a situation where the press restriction control is performed during the operation of the excavator 500, for example. Processes of flow charts of FIG. 7B and FIG. 8B described later are performed in a similar situation.

In this example, the operator can perform operations, via the display device 50 or the like, such as setting the upper limit value UL1 corresponding to the control condition related to the press restriction control, and canceling the set upper limit value UL1. In addition, in this example, the operator can set the upper limit value UL1 via the display device or the like, regardless of whether the press restriction control is being performed. The same holds true in the cases of the flow charts of FIG. 7A and FIG. 7B, and the flow charts of FIG. 8A and FIG. 8B, described later.

As illustrated in FIG. 6A, in step S602, the press restriction control section 303 judges, via the display device 50 or the like, whether the operator's operation to set the control condition related to the press restriction control, that is, the operation to set the upper limit value UL1, is performed. The press restriction control section 303 advances the process to step S604 when the operator's operation to set the upper limit value UL1 is performed, and otherwise ends the current process.

In step S604, the press restriction control section 303 judges whether the set control condition is changed from the initial setting. The press restriction control section 303 advances the process to step S606 when the control condition is changed from the initial setting, and advances the process to step S608 when the control condition is not changed from the initial setting.

In step S606, the press restriction control section 303 starts the press restriction control under the control condition to which the initial setting is changed by the operator. More particularly, the press restriction control section 303, outputs to the variable relief valve 54, the control command that sets the relief pressure to the threshold value Pth1 corresponding to the upper limit value UL1 to which the initial setting is changed by the operator, to operate the variable relief valve 54. Hence, the rod pressure of the boom cylinder 7 is restricted to the threshold value Pth1, corresponding to the upper limit value UL1 to which the initial setting is changed by the operator, or less, and the lowering operation of the boom 4 is restricted so that the lowering force or speed of the bucket 6 becomes the upper limit value UL1 or less.

On the other hand, in step S608, the press restriction control section 303 starts the press restriction control under the control condition that is maintained to the initial setting by the operator. More particularly, the press restriction control section 303 outputs, to the variable relief valve 54, the control command that sets the relief pressure to the threshold value Pth1 corresponding to the upper limit value UL1 of the initial setting, to operate the variable relief valve 54. Hence, the rod pressure of the boom cylinder 7 is restricted to the threshold value Pth1 corresponding to the upper limit value UL1 of the initial setting, or less, and the lowering operation of the boom 4 is restricted so that the lowering force or speed of the bucket 6 becomes the upper limit value UL1 or less.

The press restriction control section 33 may, at the same time as the processes of steps S606 and S608, output a display and a speech via the display device 50 and the speech output device 52, to notify the setting of the control condition related to the press restriction control, that is, the upper limit value UL1, and the start of the press restriction control, in response to the operator's operation. The same holds true in the cases of steps S706 and S708 of FIG. 7A, and steps S806 and S808 of FIG. 8A, described later. In addition, as illustrated in FIG. 6B, in step S610, the press restriction control section 303 judges, via the display device 50 or the like, whether the operator's operation to change the setting of the control condition related to the press restriction control, that is, the operation to change the setting of the upper limit value UL1, is performed. The press restriction control section 303 advances the process to step S612 when the operator's operation to change the setting of the upper limit value UL1 is performed, and otherwise advances the process to step 614.

In step S612, the press restriction control section 303 changes the control condition related to the press restriction control, according to a change operation performed by the operator. More particularly, the press restriction control section 303 outputs, to the variable relief valve 54, the control command that changes the relief pressure to the threshold value Pth1 corresponding to the upper limit value UL1 to which the setting is changed by the operator. Hence, the lowering operation of the boom 4 is restricted so that the lowering force or speed of the bucket 6 is restricted to the upper limit value UL1 of the newly changed setting, or less.

The press restriction control section 303 may, at the same time as the process of step S612, output a display and a speech via the display device 50 and the speech output device 52, to notify the change in the setting of the control condition related to the press restriction control, that is, the upper limit value UL1, in response to the operator's operation. The same holds true in the cases of step S712 of FIG. 7B, and step S812 of FIG. 8B, described later.

On the other hand, in step S614, the press restriction control section 303 judges, via the display device 50 or the like, whether the operator's operation to cancel the control condition related to the press restriction control, that is, the operation to cancel the upper limit value UL1, is performed. The press restriction control section 303 advances the process to step S616 when the operator's operation to cancel the upper limit value UL1 is performed, and otherwise ends the current process.

In step S616, the press restriction control section 303 stops the press restriction control. More particularly, the press restriction control section 303 outputs the control command to the variable relief valve 54, to stop the variable relief valve 54, and the current process ends. As a result, the restriction of the lowering operation of the boom 4 using the upper limit value is canceled.

Accordingly, in this example, the press restriction control section 303 performs the press restriction control by setting the relief pressure of the variable relief valve 54 to the threshold value Pth1 corresponding to the upper limit value UL1, based on the initial setting, or the upper limit value UL1 to which the setting is changed, by the setting performed by the operator. Hence, the lowering operation of the boom 4 is restricted so that the lowering force or speed of the bucket 6 becomes the upper limit value UL or less. For this reason, when performing the slope finishing operation, it is possible to reduce a case where the slope collapses due to the pressing force on the bucket 6 that is too large or the like. The same holds true in the cases of the flow charts of FIG. 7A and FIG. 8A, described later.

In addition, in this example, the press restriction control section 303 starts the press restriction control according to the operator's operation to set the control condition (the upper limit value UL1), and stops the press restriction control according to the operator's operation to cancel the control condition (the upper limit value UL1). Hence, the operator can start and stop (cancel) the press restriction control, by performing the setting operation and the cancel operation of upper limit value UL1 that is the control condition related to the press restriction control.

Further, in this example, in the case where the press restriction control is performed, the press restriction control section 303 changes the control condition (the upper limit value UL1) when the operator performs the setting operation (the change operation) of the control condition (the upper limit value UL1). Hence, the operator can cause the excavator 500 to perform the slope finishing operation, while adjusting the upper limit value UL1 corresponding to the control condition related to the press restriction control, according to the state of the operation site (for example, the hardness of the ground or the like). For this reason, the operator can find the appropriate upper limit value UL1 according to the state of the operation site, and thus, further reduce the case where the slope collapses during the slope finishing operation. The same holds true in the cases of the flow charts of FIG. 7A and FIG. 8A, described later.

Moreover, in this example, the press restriction control section 303 can perform the press restriction control based on the control condition of the default state (the initial setting), more particularly, the upper limit value UL1 of the initial setting. For this reason, even in a case where the operator is unsure of the value to be set for the upper limit value UL1, for example, it is possible to appropriately perform the press restriction control. In addition, because the operator can change the setting of the upper limit value UL1 using the default value as the reference, the operator can find the appropriate upper limit value UL1 according to the state of the operation site, and thus, further reduce the case where the slope collapses during the slope finishing operation. The same holds true in the cases of the flow charts of FIG. 7A and FIG. 8A, described later.

Figure 7A:
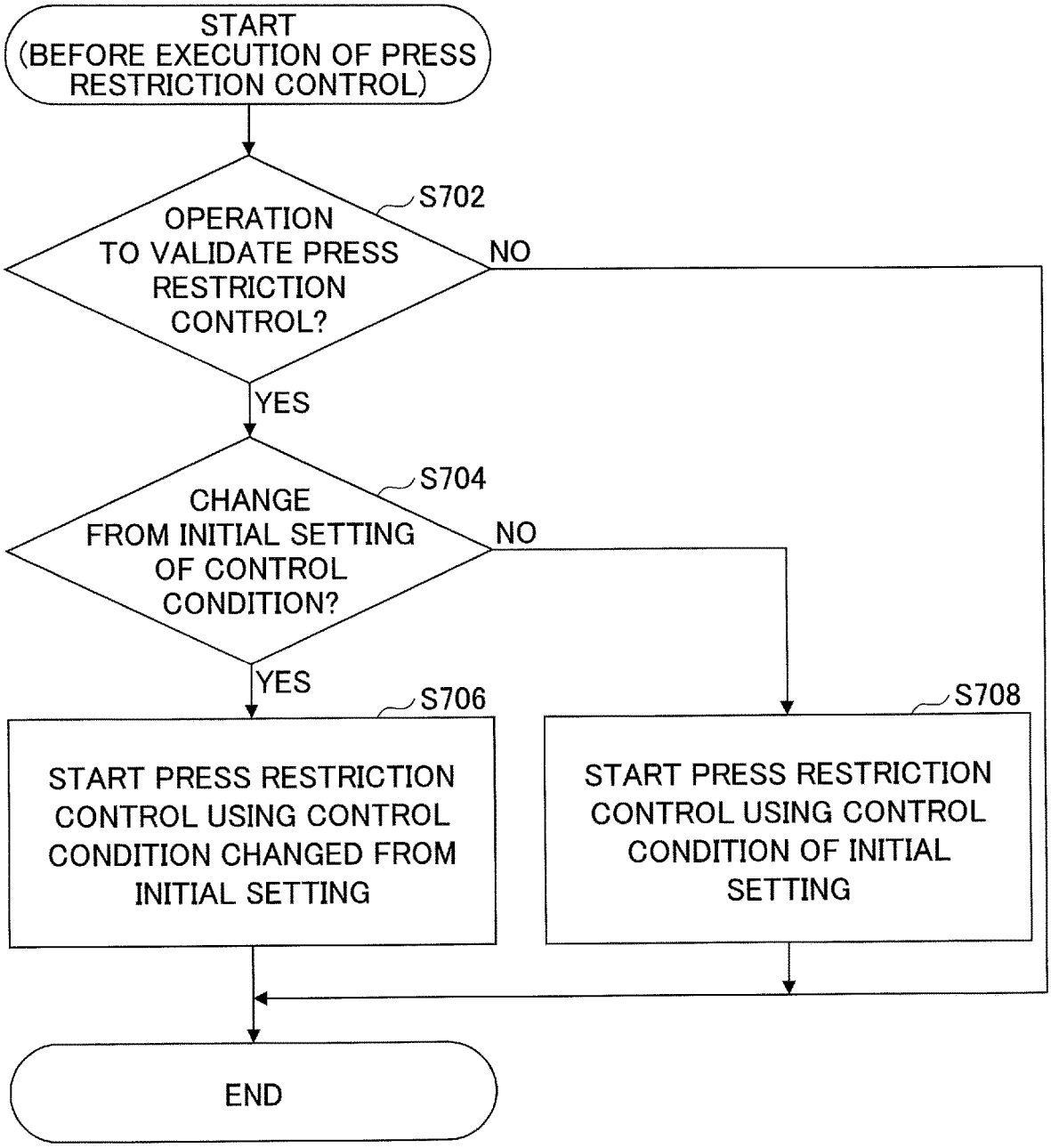
FIG. 7A is a flow chart schematically illustrating another example of the press restriction control performed by the controller.
Figure 7B:
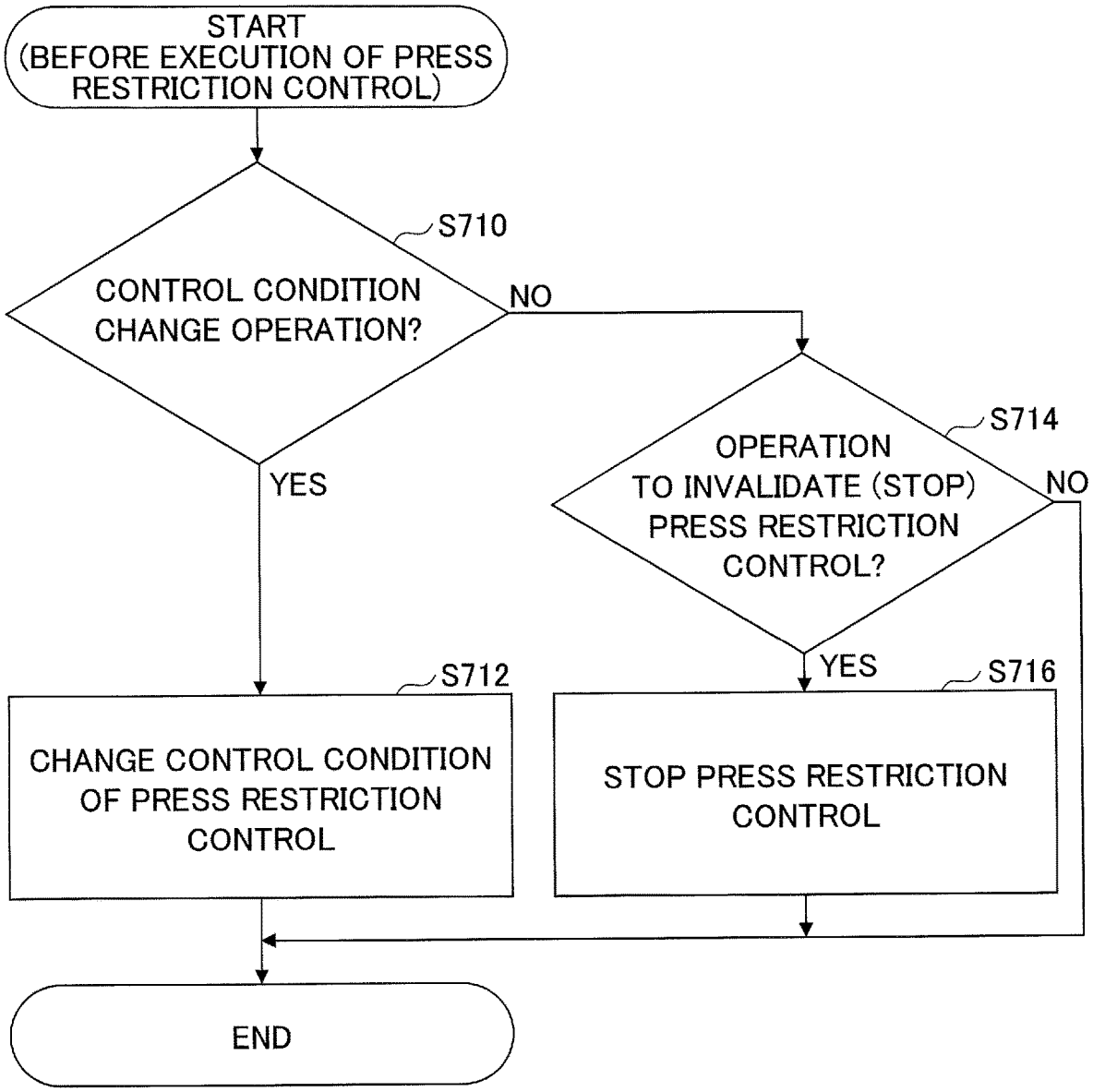
FIG. 7B is a flow chart schematically illustrating the other example of the press restriction control performed by the controller.

Next, FIG. 7A and FIG. 7B are the flow charts schematically illustrating another example of the press restriction control performed by the controller 30. More particularly, FIG. 7A and FIG. 7B respectively are the flow charts schematically illustrating the other example of the process related to the start of the press restriction control, and process related to the change of the control condition of the press restriction control and the stop of the press restriction control, performed by the controller 30.

In this example, the operator can perform the operation to validate the press restriction control, and the operation to invalidate the press restriction control of the press restriction control section 303, via the display device 50 or the like.

As illustrated in FIG. 7A, in step S702, the press restriction control section 303 judges, via the display device 50 or the like, whether the operator's operation to validate the press restriction control is performed. The press restriction control section 303 advances the process to step 704 when the operator's operation to validate the press restriction control is performed, and otherwise ends the current process.

The processes of steps S704 through S708 are the same as the process of steps S604 through S608 of FIG. 6A, and a description thereof will be omitted.

In addition, as illustrated in FIG. 7B, in step S710, the press restriction control section 303 judges, via the display device 50 or the like, whether the operator's operation to change the setting of the control condition related to the press restriction control, that is, the operation to change the setting of the upper limit value UL1, is performed, similar to step S610 of FIG. 6B. The press restriction control section 303 advances the process to step S712 when the operator's operation to change the setting of the upper limit value UL1 is performed, and otherwise advances the process to step 714.

The process of step S712 is the same as the process of step S612 of FIG. 6A, and a description thereof will be omitted.

On the other hand, in step S714, the press restriction control section 303 judges, via the display device 50 or the like, whether the operator's operation to invalidate the press restriction control (that is, the operation to stop the press restriction control) is performed. The press restriction control section 303 advances the process to step S716 when the operator's operation to invalidate the press restriction control is performed, and advances the process to step 716 when the operator's operation to invalidate the press restriction control is not performed.

The process of step S716 is the same as the process of step S616 of FIG. 6B, and a description thereof will be omitted.

Accordingly, in this example, the press restriction control section 303 starts the press restriction control according to the operator's operation to validate the press restriction control, and stops the press restriction control according to the operator's operation to invalidate the press restriction control. Hence, the operator can specifically perform the operation to validate or invalidate the press restriction control, thereby starting or stopping the press restriction control.

Figure 8A:
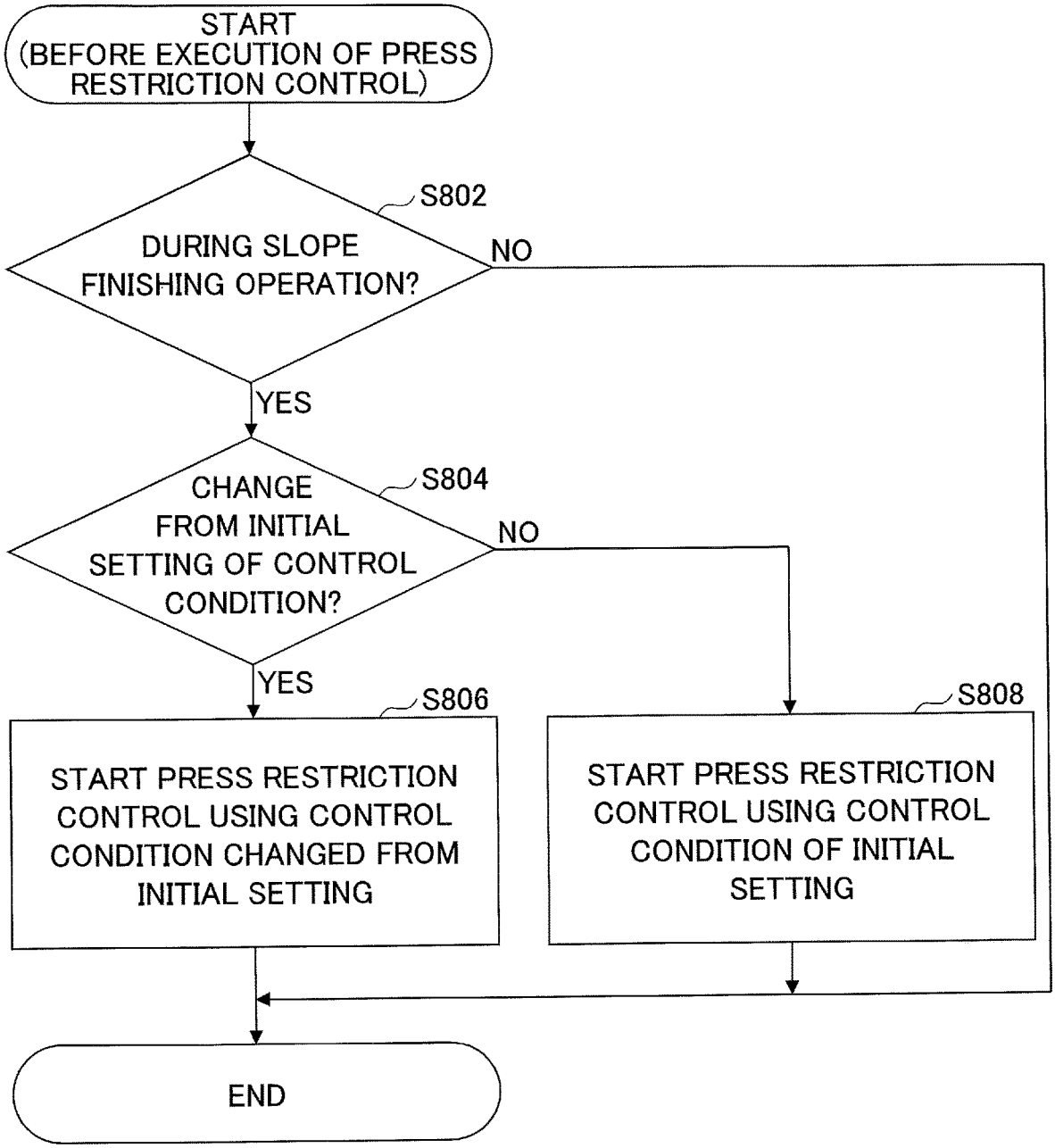
FIG. 8A is a flow chart schematically illustrating a further example of the press restriction control performed by the controller.
Figure 8B:
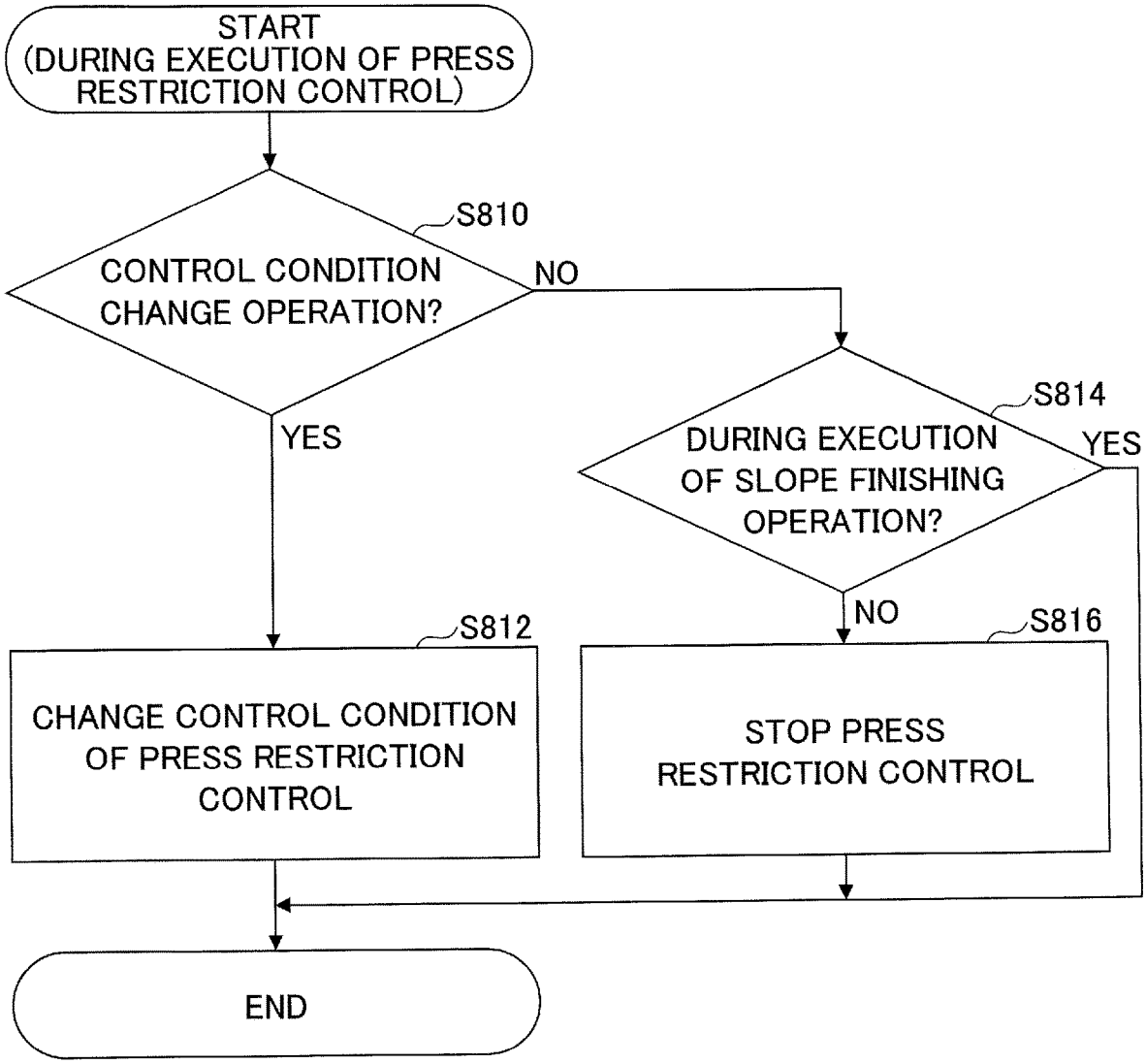
FIG. 8B is a flow chart schematically illustrating the further example of the press restriction control performed by the controller.

Next, FIG. 8A and FIG. 8B are the flow charts schematically illustrating a further example of the press restriction control performed by the controller 30. More particularly, FIG. 8A and FIG. 8B respectively are the flow charts schematically illustrating the further example of the process related to the start of the press restriction control, and process related to the change of the control condition of the press restriction control and the stop of the press restriction control, performed by the controller 30.

As illustrated in FIG. 8A, in step S802, the operating state judging section 301 judges whether the excavator 500 is performing the slope finishing operation. The operating state judging section 301 advances the process to step S804 when the excavator 500 is performing the slope finishing operation, and otherwise ends the current process.

In step S802, the operating state judging section 301 may judge whether the lifting action of the excavator 500 occurred, in place of, or in addition to judging whether the excavator 500 is performing the slope finishing operation. Moreover, in step S802, the operating state judging section 301 judge whether the lifting action of the excavator 500 is likely to occur, in place of, or in addition to judging whether the lifting action of the excavator 500 occurred. When the excavator 500 is performing the slope finishing operation in this case, the operating state judging section 301 advances the process to step S804 when the lifting action of the excavator 500 occurred, or the lifting action of the excavator 500 is likely to occur, and otherwise ends the current process.

The processes of steps S804 through S808 are the same as the process of steps S604 through S608 of FIG. 6A, and a description thereof will be omitted.

In addition, as illustrated in FIG. 8B, in step S810, the press restriction control section 303 judges, via the display device 50 or the like, whether the operator's operation to change the setting of the control condition related to the press restriction control, that is, the operation to change the setting of the upper limit value UL1, is performed, similar to step S610 of FIG. 6B. The press restriction control section 303 advances the process to step S812 when the operator's operation to change the setting of the upper limit value UL1 is performed, and otherwise advances the process to step 814.

The process of step S812 is the same as the process of step S612 of FIG. 6A, and a description thereof will be omitted.

On the other hand, in step S814, the operating state judging section 301 judges whether the excavator 500 is performing the slope finishing operation. The operating state judging section 301 advances the process to step S816 when the excavator 500 is not performing the slope finishing operation, and ends the current process when the excavator 500 is performing the slope finishing operation.

In step S814, the operating state judging section 301 may judge, in correspondence with step S802, whether the lifting action of the excavator 500 occurred, in place of, or in addition to judging whether the excavator 500 is performing the slope finishing operation. In addition, in step S814, the operating state judging section 301 may judge whether the lifting action of the excavator 500 is likely to occur, in place of, or in addition to judging whether the lifting action of the excavator 500 occurred. When the excavator 500 is performing the slope finishing operation in this case, the operating state judging section 301 ends the current process when the lifting action of the excavator 500 occurred, or the lifting action of the excavator 500 is likely to occur, and otherwise advances the process to step S816.

The process of step S816 is the same as the process of step S616 of FIG. 6B, and a description thereof will be omitted.

Accordingly, in this example, the press restriction control section 303 performs (starts) the press restriction control when the operating state judging section 301 judges that the excavator 500 is performing the slope finishing operation. Hence, the press restriction control section 303 can perform the press restriction control when the excavator 500 performs the slope finishing operation, regardless of the operator's operation. For this reason, even when the operator forgets to perform the operation to validate the press restriction control, for example, it is possible to reduce a case where the slope finishing operation of the excavator 500 is performed without restricting the lowering operation of the boom 4.

Moreover, in the situation where the press restriction control is being performed but the operating state judging section 301 judges that the excavator 500 is not performing the slope finishing operation, the press restriction control section 303 can stop the press restriction control. In this case, when the excavator 500 ends the slope finishing operation, the press restriction control section 303 can automatically stop the press restriction control regardless of the operator's operation. For this reason, even when the operator forgets to perform the operation to invalidate the press restriction control, for example, it is possible to reduce a case where excavator 500 performs another operation in a state in which the lowering operation of the boom 4 remains restricted, thereby deteriorating the efficiency of the operation.

In addition, the press restriction control section 303 may perform (start) the press restriction control when the operating state judging section 301 judges that the lifting action of the excavator 500 occurred, or is likely to occur. Hence, the press restriction control section 303 can perform the press restriction control when the lifting action of the excavator 500 occurred, or is likely to occur, regardless of the operator's operation. For this reason, even when the operator forgets to perform the operation to validate the press restriction control, for example, it is possible to reduce a case where the lifting action occurs during the slope finishing operation without the lowering operation of the boom 4 being restricted.

Further, in the situation where the press restriction control is being performed, the press restriction control section 303 can stop the press restriction control when the operating state judging section 301 judges that the lifting action of the excavator 500 occurred, or is likely to occur. Hence, the press restriction control section 303 can automatically stop the press restriction control when the lifting action itself of the excavator 500, or the situation where the lifting action is likely to occur, converges, regardless of the operator's operation. For this reason, even when the operator forgets to perform the operation to invalidate the press restriction control, for example, it is possible to reduce a case where the operation of the excavator 500 continues in a state in which the lowering operation of the boom 4 remains restricted, thereby deteriorating the efficiency of the operation.

[Particular Examples of Operation Stop Control]

FIG. 9 through FIG. 11B are flow charts schematically illustrating examples of an operation stop control performed by the controller 30. In the following, the particular examples of the operation stop control of FIG. 10 and FIG. 11A may be suitably combined. For example, processes of the particular examples of the operation stop control of FIG. 10 and FIG. 11A may be performed in parallel.

Figure 9:
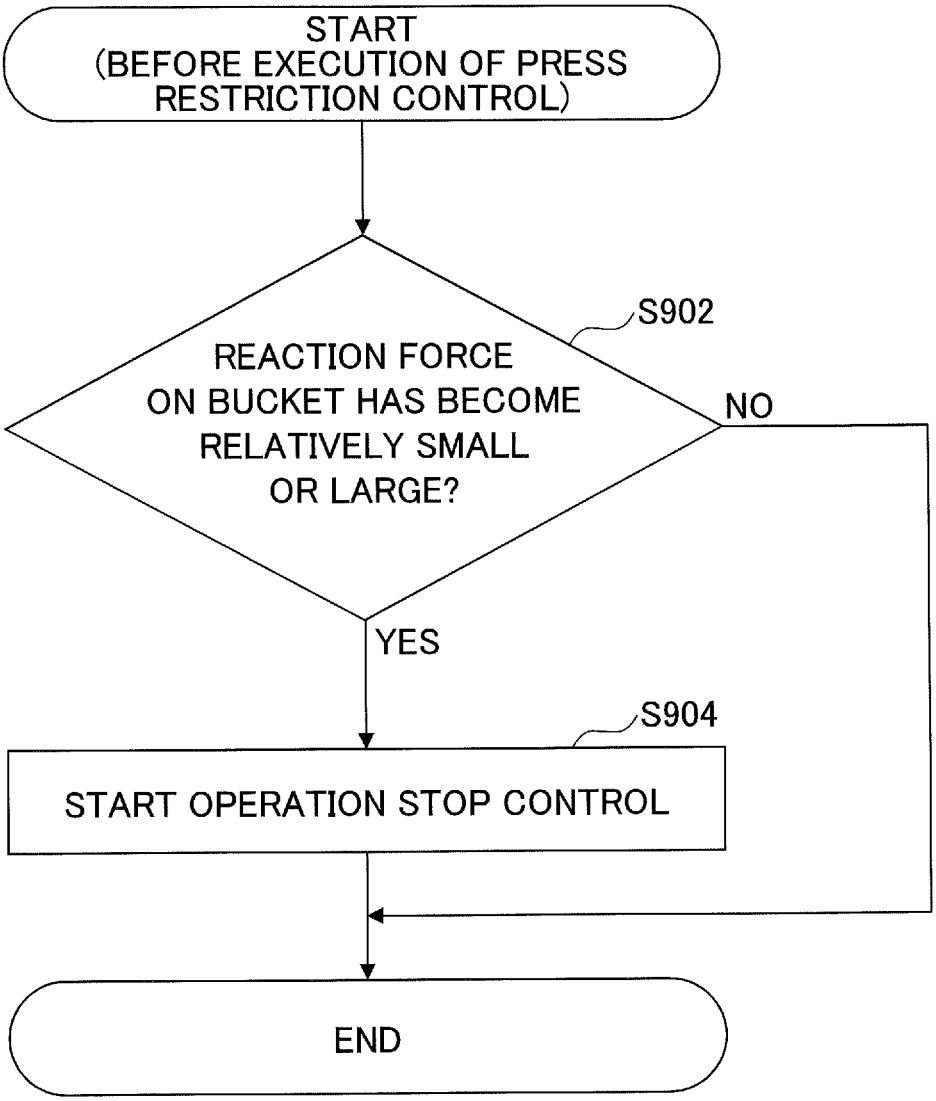
FIG. 9 is a flow chart schematically illustrating an example of an operation stop control performed by the controller.

First, FIG. 9 is the flow chart schematically illustrating the example of the operation stop control of the controller 30. More particularly, FIG. 9 is the flow chart schematically illustrating the example of the process related to the start of the operation stop operation of the controller 30. The process of this flow chart is repeatedly performed for every predetermined control period, when the process of step S904, that will be described later and restricts the lowering operation of the boom 4 (that is, the operation stop control) to stop the slope finishing operation, for example, is not performed during the operation of the excavator 500. The same holds true in the cases of the flow charts of FIG. 10 and FIG. 11A described later.

In step S902, the press reaction force judging section 302 judges whether the reaction force from the slope with respect to the bucket 6 became relatively small or relatively large. More particularly, the press reaction force judging section 302 judges whether the reaction force from the slope with respect to the bucket 6 became the first reference or less, or exceeded the second reference. The press reaction force judging section 302 advances the process to step S904 when the reaction force from the slope with respect to the bucket 6 became relatively small or relatively large, and otherwise ends the current process.

In step S904, the operation stop control section 304 starts the operation stop control. More particularly, the operation stop control section 304 outputs, to the variable relief valve 54, the control command that sets the relief pressure to the threshold value Pth2 corresponding to the upper limit value UL2, to operate the variable relief valve 54. Accordingly, because the rod pressure of the boom cylinder 7 is restricted to the threshold value Pth2 corresponding to the upper limit value UL2, or less, the lowering operation of the boom 4 is restricted so that the lowering force or speed of the bucket 6 becomes the upper limit value UL2 or less. For this reason, by the effects of the upper limit value UL2 and the threshold value Pth2 that are set to extremely small values, it is possible to stop the slope finishing operation of the excavator 500.

The restriction of the lowering operation of the boom 4, that is, the operation stop control, started by the process of step S904, may be cancelled by a predetermined cancel operation performed by the operator via the display device 50 or the like, for example. The same holds true for the restriction of the lowering operation of the boom 4, that is, the operation stop control, started by the process of step S1006 of FIG. 10 that will be described later. In addition, the operation stop control section 304 may, at the same time as the process of step S904, output a display and a speech via the display device 50 and the speech output device 52, to notify that the operation of the boom 4 is restricted, and the slope finishing operation is stopped. Hence, the operator can perform the cancel operation described above according to the notification, and cancel the restriction of the lowering operation of the boom 4. The same holds true in the cases of step S1006 of FIG. 10, and step S1106 of FIG. 11A, described later.

Accordingly, in this example, when the reaction force from the ground (the slope) with respect to the bucket 6 becomes relatively small or relatively large, the operation stop control section 304 restricts the lowering operation of the boom 4 more than the press restriction control. More particularly, when the reaction force from the slope with respect to the bucket 6 becomes the first reference or less, or exceeds the second reference, the operation control stop section 304 sets the relief pressure of the variable relief valve 54 to the threshold value Pth2 corresponding to the upper limit value UL2. Hence, the lowering operation of the boom 4 is restricted so that the lowering force or speed of the bucket 6 becomes the upper limit value UL2 or less, that is, becomes the level at which the slope finishing operation cannot be continued, thereby stopping the slope finishing operation of the excavator 500. For this reason, it is possible to reduce the case where the slope collapses as a result of the slope finishing operation that is continued in the situation where the slope may collapse. The same holds true in the cases of the flow chart of FIG. 11A described later.

Figure 10:
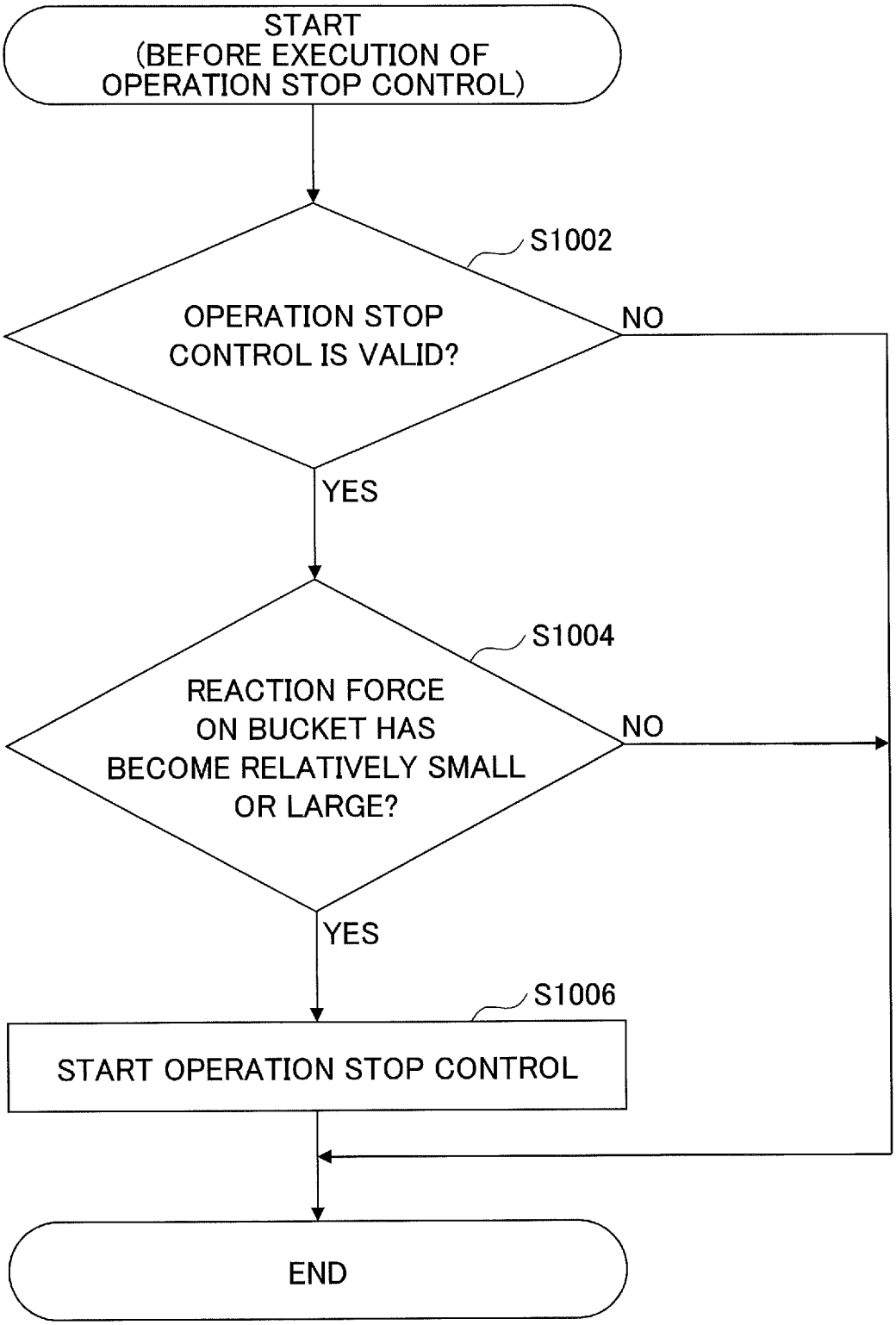
FIG. 10 is a flow chart schematically illustrating another example of the operation stop control performed by the controller.

Next, FIG. 10 is a flow chart schematically illustrating another example of the operation stop control performed by the controller 30. More particularly, FIG. 10 is the flow chart schematically illustrating the other example of the process related to the start of the operation stop control performed by the controller 30.

In this example, the operator can perform the operation to validate the operation stop control, and the operation to invalidate the operation stop control of the operation stop control section 304, via the display device 50 or the like.

In step S1002, the operation stop control section 304 judges whether the operation stop control is valid, according to a predetermined operation performed by the operator via the display device 50 or the like. The operation stop control section 304 advances the process to step S1004 when the operation stop control is valid, and otherwise ends the current process.

The processes of steps S1004 and S1006 are the same as the process of steps S902 and S904 of FIG. 9, and a description thereof will be omitted.

Accordingly, in this example, when the operation stop control is valid according to the predetermined operation performed by the operator, and the reaction force from the slope with respect to the bucket 6 is the predetermined reference or less, the operation stop control section 304 sets the relief pressure of the variable relief valve 54 to the threshold value Pth2 corresponding to the upper limit value UL2. Hence, it is possible to restrict the operation of the boom 4 to an extent such that the slope finishing operation cannot be continued, provided that the operation stop control is validated according to the operator's operation. For this reason, the operator can validate the operation stop control when starting the slope finishing operation by the excavator 500, and otherwise invalidate the operation stop control, so as to reduce the case where an unnecessary operation restriction of the operation of the boom 4 occurs during an operation other than the slope finishing operation.

Figure 11A:
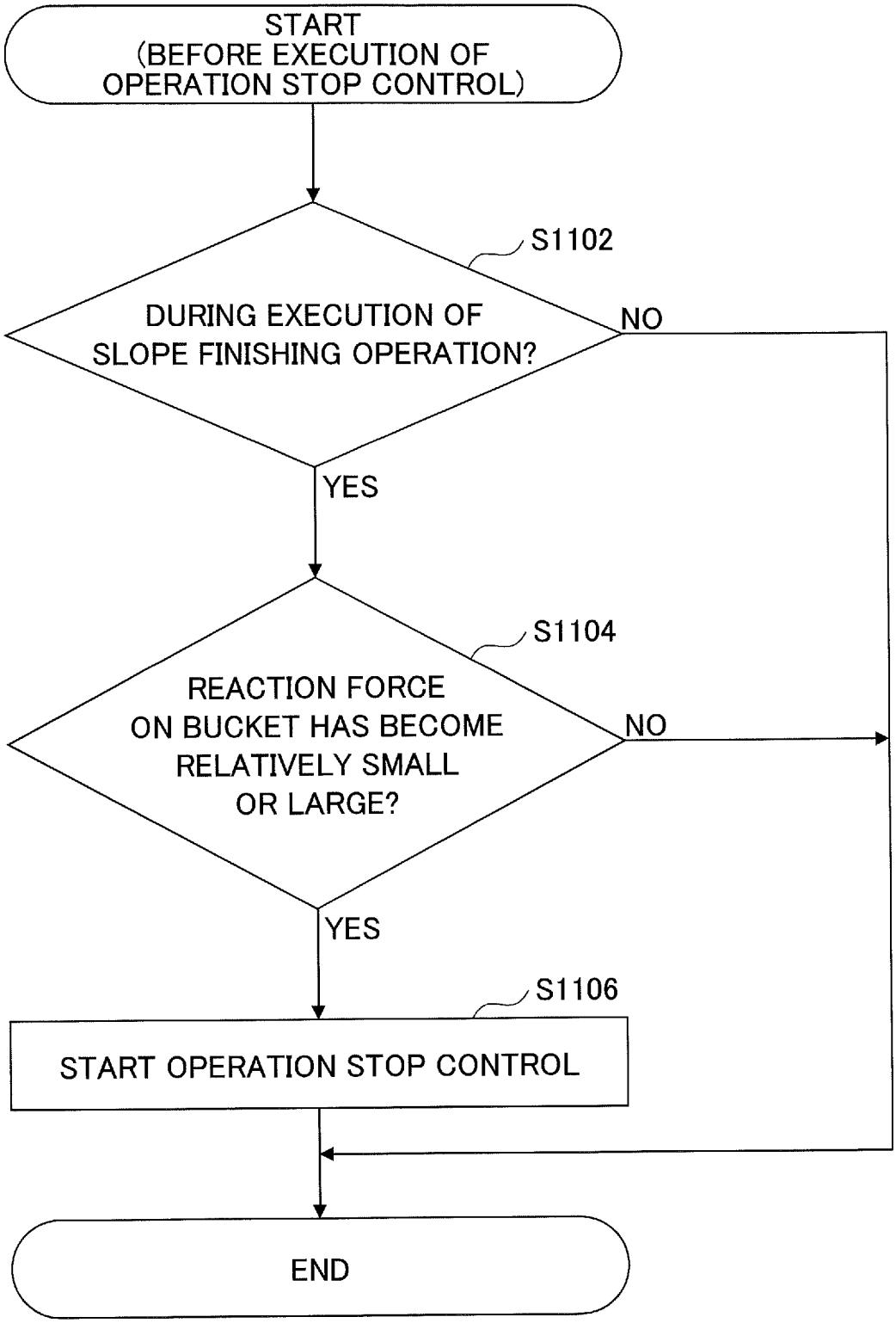
FIG. 11A is a flow chart schematically illustrating a further example of the operation stop control performed by the controller.
Figure 11B:
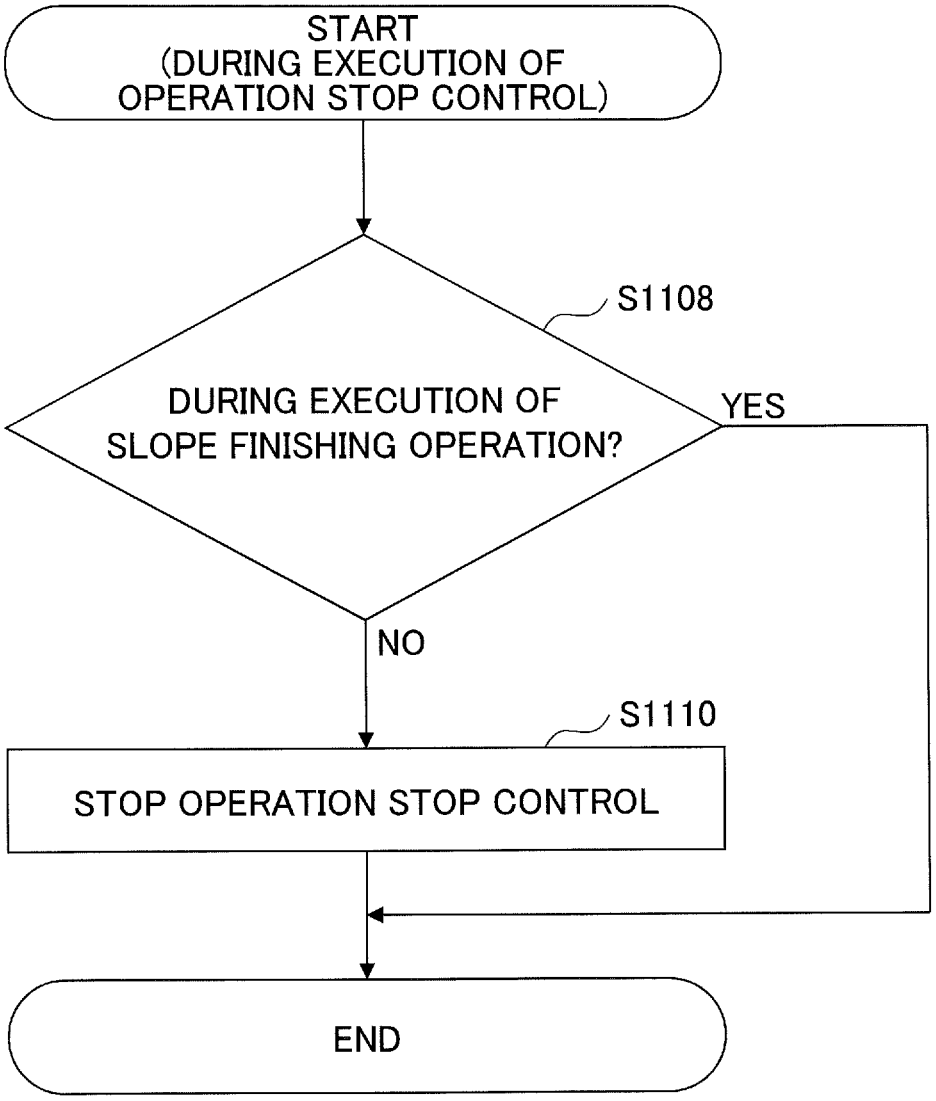
FIG. 11B is a flow chart schematically illustrating the further example of the operation stop control performed by the controller.

Next, FIG. 11A and FIG. 11B are flow charts schematically illustrating a further example of the operation stop control performed by the controller 30. More particularly, FIG. 11A is a flow chart schematically illustrating the further example of the process related to the start of the operation stop control performed by the controller 30, and FIG. 11B is the flow chart schematically illustrating the further example of the process related to the stop of the operation stop control performed by the controller 30. The process of the flow chart of FIG. 11B is repeatedly performed for every predetermined control period, in the situation where the operation stop control is performed during the operation of the excavator 500, for example.

As illustrated in FIG. 11A, in step S1102, the operation state judging section 301 judges whether the excavator 500 is performing the slope finishing operation. The operation state judging section 301 advances the process to step 1104 when the excavator 500 is performing the slope finishing operation, and otherwise ends the current process.

In step S1102, instead of judging whether the excavator 500 is performing the slope finishing operation, it is possible to judge whether the press restriction control illustrated in FIG. 6A through FIG. 8B is performed. This is because the state where the press restriction control is performed, may be regarded as being equivalent to the state where the excavator 500 performs the slope finishing operation.

The processes of steps S1104 and S1106 are the same as the process of steps S902 and S904 of FIG. 9, and a description thereof will be omitted.

In addition, as illustrated in FIG. 11B, in step S1108, the operation state judging section 301 judges whether the excavator 500 is performing the slope finishing operation. The operation state judging section 301 advances the process to step S1110 when the excavator 500 is not performing the slope finishing operation, and ends the current process when the excavator 500 is performing the slope finishing operation.

In step S1110, the operation stop control section 304 stops the operation stop control. More particularly, the operation stop control section 304 outputs the control command to the variable relief valve 54, to put the variable relief valve 54 in a stopped state, and ends the current process. Hence, when the excavator 500 is not performing the slope finishing operation, the operation stop control section 304 can stop the variable relief valve 54, and cancel the restriction on the lowering operation of the boom 4.

Accordingly, in this example, when the excavator 500 is performing the slope finishing operation and the reaction force from the slope with respect to the bucket 6 becomes the predetermined reference or less, the operation stop control section 304 sets the relief pressure of the variable relief valve 54 to the threshold value Pth2 corresponding to the upper limit value UL2. Hence, it is possible to restrict the operation of the boom 4 to an extent such that the slope finishing operation cannot be continued, provided that the slope finishing operation is performed. In addition, it is possible to improve convenience to the operator, because the operator is not required to perform an operation to validate the operation stop control, an operation to cancel the operation stop control, or the like. Moreover, even when the operator forgets to perform the operation to validate the operation stop control, and the slope may collapse, it is possible to reduce a case where the operation stop control is not performed.

Further, in this example, when the excavator 500 no longer performs the slope finishing operation, the operation stop control section 304 stops the operation of the variable relief valve 54, and cancels the restriction of the lowering operation of the boom 4. Hence, when the excavator 500 no longer performs the slope finishing operation, it is possible to automatically cancel the restriction of the lowering operation of the boom 4 to the extent that stops the slope finishing operation, regardless of the operator's operation. For this reason, it is possible to improve the convenience to the operator. In addition, when the operator forgets to perform the operation to cancel the operation stop control or the like, even though the slope finishing operation ended, it is possible to reduce a case where the valid state of the operation stop control is caused to continue thereby, and the lowering operation of the boom 4 becomes restricted.

[Effects]

In this embodiment, the controller 30 (the press restriction control section 303) performs the press restriction control to restrict the lowering operation of the boom 4, so that the pressing force that presses the bucket 6 against the ground, or the lowering speed at which the bucket 6 is lowered toward the ground, does not become relatively large. More particularly, the press restriction control section 303 performs the press restriction control to restrict the lowering operation of the boom 4, so that the pressing force that presses the bucket 6 against the ground, or the lowering speed at which the bucket 6 is lowered toward the ground, becomes the prescribed upper limit value UL1 or less.

Accordingly, the excavator 500 (the slope finishing support control device 200) can restrict the lowering operation of the boom 4 during the slope finishing operation of the excavator 500. Hence, the slope finishing support control device 200 can reduce the case where the pressing force of the bucket 6 against the slope becomes excessively large to cause the collapse of the slope and the lifting action of the excavator 500 to occur. Hence, the excavator 500 can appropriately perform the slope finishing operation while maintaining the workability.

Moreover, in this embodiment, the controller (the press restriction control section 303) controls the boom cylinder 7 so that the pressure in the rod side oil chamber of the boom cylinder 7 becomes the threshold value Pth1 corresponding to the upper limit value UL1, or less, to restrict the lowering operation of the boom 4, and perform the press restriction control.

Accordingly, the excavator 500 (the slope finishing support control device 200) can restrict the operation on a contraction side of the boom cylinder 7, and more particularly, restrict the lowering operation of the boom 4.

In addition, in this embodiment, the controller 30 (the press restriction control section 303) can restrict the lowering operation of the boom 4, and perform the press restriction control, by setting the relief pressure of the variable relief valve 54 that is connected to the rod side oil chamber of the boom cylinder 7 to the threshold value Pth1 and operating the variable relief valve 54.

Therefore, the excavator 500 (the slope finishing support control device 200) can specifically restrict the rod pressure of the boom cylinder 7.

Further, in this embodiment, the display device 50 or the like accepts, as a setting operation section, the control condition related to the press restriction control, more particularly, the operation that sets the upper limit value UL1, according to the operation with respect to the touchscreen panel.

Hence, the operator, on his own, can adjust the control condition (the upper limit value UL1) related to the press restriction control.

Moreover, in this embodiment, the control condition related to the press restriction control is changed using the prescribed initial condition (the initial setting) as the reference, according to the operation with respect to the setting operation section (the display device 50 or the like).

Accordingly, even in a situation where the operator is unsure of how to set the control condition, the operator, on his own, can set the control condition using the initial condition (for example, the recommended condition) as the reference.

In addition, in this embodiment, the controller 30 (the press restriction control section 303) restricts the lowering operation of the boom 4, and performs (starts) the press restriction control, when the control condition (the upper limit value UL1) related to the press restriction control is set via the display device 50 or the like.

Hence, the operator can validate (start) the press restriction control of the excavator 500 (the slope finishing support control 200), by setting the upper limit value UL1.

Further, in this embodiment, the display device 50 or the like functions as a validating operation section that validates the press restriction control, according to the operator's operation. The press restriction control section 303 restricts the lowering operation of the boom 4, and performs (starts) the press restriction control, when the operation is performed with respect to the validating operation section.

Accordingly, the operator can validate (start) the press restriction control of the excavator 500 (the slope finishing support control device 200), by performing the operation to validate the press restriction control.

Moreover, in this embodiment, the controller 30 (the operation state judging section 301) judges whether the excavator 500 is performing the slope finishing operation. When the operation state judging section 301 judges that the excavator is performing the slope finishing operation, the press restriction control section 303 performs the press restriction control to restrict the lowering operation of the boom 4.

Accordingly, the excavator 500 (the slope finishing support control device 200) can perform the press restriction control, provided that the excavator 500 is performing the slope finishing operation. For this reason, it is possible to reduce the case where an unnecessary press restriction control, such as the restriction or the like of the lowering operation of the boom 4, is performed when the slope finishing operation is not being performed.

In addition, in this embodiment, the controller 30 (the operation state judging section 301) judges whether the excavator 500 is performing the slope finishing operation, based on the pressure (rod pressure) in the rod side oil chamber of the boom cylinder 7 that drives the boom 4, or the captured image from the camera 44 that captures a vicinity of the excavator 500.

Accordingly, the excavator 500 (the slope finishing support control device 200) can specifically judge whether the excavator 500 is performing the slope finishing operation.

Moreover, in this embodiment, the controller 30 (the operation state judging section 301) judges whether the lifting action of the excavator 500 occurred, or is likely to occur. The controller 30 (the press restriction control section 303) can perform the press restriction control to restrict the lowering operation of the boom 4, when the controller 30 judges that the lifting action of the excavator 500 occurred, or is likely to occur.

Hence, the excavator 500 (the slope finishing support control device 200) can perform the press restriction control, provided that the lifting action of the excavator 500 occurred, or is likely to occur. For this reason, it is possible to reduce the case where the unnecessary press restriction control, such as the restriction or the like of the lowering operation of the boom 4, is performed when the lifting action of the excavator 500 has not occurred or is unlikely to occur.

In addition, in this embodiment, the operating state sensor 46 outputs, to the controller 30, the information related to the inclination angle of the vehicle of the excavator 500 in the pitch direction. Further, the controller 30 (the operation state judging section 301) judges whether the lifting action of the excavator 500 occurred, or is likely to occur, based on the detection result of the operating state sensor 46.

Therefore, the excavator 500 (the slope finishing support control device 200) can specifically judge whether the lifting action of the excavator 500 occurred, or is likely to occur, based on the information related to the inclination angle in the pitch direction, a change thereof (the angular acceleration and the angular jerk), or the like.

Further, in this embodiment, the operating state sensor 46 may include the inclination sensor, the angular velocity sensor, the IMU, or the like.

Accordingly, the excavator 500 (the slope finishing support control device 200) can specifically acquire the sensor information (the information related to the inclination angle in the pitch direction) used for judging the lifting action of the excavator 500.

Moreover, in this embodiment, the controller 30 (the press reaction force judging section 302) judges whether the reaction force from the slope with respect to the bucket 6 became relatively small, or relatively large. More particularly, the press reaction force judging section 302 judges whether the reaction force from the slope with respect to the bucket 6 became the first reference or less, or exceeded the second reference that is sufficiently large compared to the first reference. When the press reaction force judging section 302 judges that the reaction force 6 became relatively small (that is, became the first reference or less), or relatively large (that is, exceeded the second reference), the controller 30 (the operation stop control section 304) performs the operation stop control that further restricts the lowering operation of the boom 4 than the press restriction control, so that the pressing force of the bucket 6 against the ground, or the lowering speed of the bucket 6 toward the ground, becomes relatively small. More particularly, the operation stop control section 304 restricts the lowering operation of the boom 4 so that the pressing force of the bucket 6 against the ground, or the lowering speed of the bucket 6 toward the ground, becomes the upper limit value UL2 that is smaller than the upper limit value UL1, or less.

Hence, when the reaction force from the slope with respect to the bucket 6 becomes the first reference or less corresponding to the situation where the slope becomes fragile and there are signs of collapse, for example, the excavator 500 (the slope finishing support control device 200) can more greatly restrict the lowering operation of the boom 4 than the press restriction control, and stop the slope finishing operation. In addition, when the reaction force from the slope with respect to the bucket 6 exceeds the second reference due to the rocks or the like within the earth and sand, for example, the excavator 500 can more greatly restrict the lowering operation of the boom 4 than the press restriction control, and stop the slope finishing operation. Accordingly, in such a situation, it is possible to reduce the case where the slope collapses as a result of the slope finishing operation that is continued.

In addition, in this embodiment, the press reaction force judging section 302 judges whether the reaction force from the slope with respect to the bucket 6 became relatively small (became the first reference or less), or relatively large (exceeds the second reference), based on a change in the pressure in the rod side oil chamber of the boom cylinder 7 that drives the boom 4.

Accordingly, the excavator 500 (the slope finishing support control device 200) can judge whether the reaction force from the slope with respect to the bucket 6 became relatively small (became the first reference or less), or relatively large (exceeded the second reference).

According to described embodiments, it is possible to provide an excavator that can appropriately perform the slope finishing operation to prepare the slope, while maintaining the workability.

The features of the embodiments according to the present invention are described above in detail, but the present invention is not limited to particular embodiments, and various variations, modifications, and substitutions may be made without departing from the scope of the present invention.

For example, in the above noted embodiments, both the press restriction control and the operation stop control are performed, however, according to one feature, only one of these controls may be performed.

Moreover, in the above noted embodiments and modifications, the press reaction control section 303 or the operation stop control section 304 may adjust the threshold values Pth1 and Pth2 that is the relief pressure of the variable relief valve 54, while monitoring a measured value (an estimated value) of the lowering force or speed of the boom 4. In this case, the press restriction control section 303 or the operation stop control section 304 can compute a measured value (an estimated value) of the lowering force of the bucket 6, from the measured value of the rod pressure of the boom cylinder 7 input from the pressure sensor 40. Further, the press restriction control section 303 or the operation stop control section 304 can compute a measured value (an estimated value) of the lowering speed of the bucket 6, based on the measured value of the rod position of the boom cylinder 7 input from the position sensor 42.

Moreover, in the above noted embodiments and modifications, the lowering operation of the boom 4 is restricted by assuming that the slope finishing operation will be performed, however, a similar control may be applied to other operations in which the pressing force of the bucket 6 against the ground or the lowering speed of the bucket 6 toward the ground is to be restricted. For example, the press restriction control may be performed during an excavating operation or the like, other than the slope finishing operation, when the lifting action of the excavator 500 occurs or is likely to occur. Further, the press restriction control may be performed when performing a prescribed operation in which the lifting action of the excavator 500 is likely to occur, without limiting the application of the press restriction control to the slope finishing operation, the excavating operation, or the like.

In addition, in the above noted embodiments and modifications, the press restriction control and the operation stop control are performed when the slope finishing operation is performed in response to the operator's operation, manually, or by the support type machine control function, and when the slope finishing operation is autonomously performed by the autonomous control function, however, the embodiments and modifications are not limited to the controls performed under such situations. For example, depending on the autonomous machine control function implemented in the excavator 500, the entire attachment may operate autonomously according to an external command, to perform the slope finishing operation. Moreover, when a remote operating function is implemented in the excavator 500, the excavator 500 may be remotely controlled from a site other than the operation site, and the slope finishing operation may be performed manually or by the support type machine control function. Of course, the above noted press restriction control and the operation stop control may be applied to cases where the slope finishing operation is performed according to the external command or according to the remote control.

Further, the press restriction control and the operation stop control is performed during the compaction operation with respect to the slope, that is, the slope finishing operation, however, the press restriction control and the operation stop control may be similarly performed during a compaction operation with respect to the horizontal surface.

In the above noted embodiments, the excavator 500 hydraulically drives the various operation elements such as the undercarriage 1, the slewing upper structure 3, the boom 4, the arm 5, the bucket 6, or the like, however, a portion of these elements may be electrically driven. In other words, the structures or the like disclosed in the above noted embodiments may be applied to a hybrid excavator, an electric excavator, or the like.

What is claimed is:

1. An excavator comprising:

a carriage;

a structure rotatably mounted on the carriage;

a boom pivotally mounted on the structure;

an arm rotatably mounted on a tip end of the boom;

a bucket mounted on a tip end of the arm;

a camera configured to capture an area in a vicinity of the excavator; and a controller configured to restrict a lowering operation of the boom so that at least one of a pressing force of the bucket against the ground and a speed of lowering the bucket toward the ground does not become relatively large, wherein the controller is configured to judge whether a lifting action of the excavator occurred or is likely to occur, and restrict the lowering operation of the boom when the controller judges that the lifting action of the excavator occurred or is likely to occur.

2. The excavator as claimed in claim 1, wherein the controller automatically makes a transition to a state that restricts the lowering operation of the boom.

3. The excavator as claimed in claim 1, wherein a control condition related to restricting the lowering operation of the boom is selected from a plurality of prescribed candidate conditions, and the plurality of prescribed candidate conditions include a first candidate that prioritizes a workability of the excavator, a second candidate that balances the workability of the excavator and a performance of the operation, and a third candidate that prioritizes the performance of the operation.

4. The excavator as claimed in claim 3, wherein the control condition related to restricting the lowering operation of the boom includes at least one of the force and the speed.

5. The excavator as claimed in claim 1, wherein a control condition related to restricting the lowering operation of the boom includes conditions related to a direction of a restricting target of at least one of the force and the speed.

6. The excavator as claimed in claim 1, wherein the controller is configured to judge whether the excavator is performing a finishing operation to prepare a slope by pressing the bucket against the slope, based on at least one of attitude states of the boom, the arm, and the bucket included in a captured image from the camera, and existence of the slope included in the captured image, or based on at least one of a measured value of a rod pressure of a boom cylinder that drives the boom, and a state of change of the measured value of the rod pressure, and restrict the lowering operation of the boom when the excavator is judged as performing the finishing operation.

7. The excavator as claimed in claim 1, wherein the controller is configured to judge whether a reaction force from the ground with respect to the bucket became relatively small or relatively large, and further restrict the lowering operation of the boom so that the force of the speed becomes relatively small when the controller judges that the reaction force from the ground with respect to the bucket became relatively small or relatively large.

8. The excavator as claimed in claim 1, wherein the controller, when restricting the lowering operation of the boom, notifies an operator inside a cabin or a remote user that the lowering operation of the boom is restricted.

9. The excavator as claimed in claim 1, wherein the controller is configured to control operations of the arm and the bucket, in addition to the operation of the boom, so that at least one of the force and the speed does not become relatively large.

10. The excavator as claimed in claim 1, wherein the controller is configured to operate at least one of the boom, the arm, and the bucket, to press a predetermined portion of the bucket against a target forming surface, and move the predetermined portion along the target forming surface, while restricting the lowering operation of the boom so that at least one of the force and the speed does not become relatively large.

11. The excavator as claimed in claim 1, wherein the controller has control modes including a first mode in which the lowering operation of the boom is not restricted, and a second mode in which the lowering mode of the boom is restricted, and the controller judges whether a lifting action of the excavator occurred or is likely to occur, based on a rod pressure of a boom cylinder that drives the boom, or based on a captured image from the camera, and automatically causes a transition from the first mode to the second mode when the controller judges that the lifting action of the excavator occurred or is likely to occur.

12. The excavator as claimed in claim 1, further comprising:

a display device provided inside a cabin, wherein the display device displays a setting screen from which a user sets at least one of the force and the speed, and wherein the setting screen displays, visually recognizably, upper limit values and lower limit values settable for the force and speed, respectively, and a value that is currently set.

13. The excavator as claimed in claim 1, further comprising:

a display device provided inside a cabin, wherein the display device displays a setting screen from which a user sets at least one of the force and the speed, and wherein the setting screen schematically displays an image of the excavator performing an operation to prepare a slope.

14. The excavator as claimed in claim 1, further comprising:

a display device provided inside a cabin, wherein the display device displays a setting screen from which a user sets at least one of the force and the speed, and wherein the setting screen displays restricting directions of the force and the speed.

15. An excavator comprising:

a carriage;

a structure rotatably mounted on the carriage;

a boom pivotally mounted on the structure;

an arm rotatably mounted on a tip end of the boom;

a bucket mounted on a tip end of the arm;

a camera configured to capture an area in a vicinity of the excavator;

a controller configured to restrict a lowering operation of the boom so that at least one of a pressing force of the bucket against the ground and a speed of lowering the bucket toward the ground does not become relatively large; and a display device provided inside a cabin, wherein the display device displays a setting screen from which a user sets at least one of the force and the speed, and wherein the setting screen displays, visually recognizably, upper limit values and lower limit values settable for the force and speed, respectively, and a value that is currently set.

16. An excavator comprising:

a carriage;

a structure rotatably mounted on the carriage;

a boom pivotally mounted on the structure;

an arm rotatably mounted on a tip end of the boom;

a bucket mounted on a tip end of the arm;

a camera configured to capture an area in a vicinity of the excavator;

a controller configured to restrict a lowering operation of the boom so that at least one of a pressing force of the bucket against the ground and a speed of lowering the bucket toward the ground does not become relatively large; and a display device provided inside a cabin, wherein the display device displays a setting screen from which a user sets at least one of the force and the speed, and wherein the setting screen schematically displays an image of the excavator performing an operation to prepare a slope.

* * * * *